US006270206B1

(12) United States Patent
Shimizu et al.

(10) Patent No.: US 6,270,206 B1
(45) Date of Patent: Aug. 7, 2001

(54) INK CONTAINER HAVING BLOCKING MEMBER AND BOUNDARY LAYER

(75) Inventors: Eiichiro Shimizu; Hajime Yamamoto, both of Yokohama; Jun Hinami, Kawasaki; Hiroki Hayashi, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/124,018

(22) Filed: Jul. 29, 1998

(30) Foreign Application Priority Data

| | | |
|---|---|---|
| Jul. 30, 1997 | (JP) | 9-204477 |
| Feb. 18, 1998 | (JP) | 10-035928 |
| Apr. 13, 1998 | (JP) | 10-101040 |
| Jul. 10, 1998 | (JP) | 10-195716 |

(51) Int. Cl.[7] ..... B41J 2/175
(52) U.S. Cl. ..... 347/86
(58) Field of Search ..... 347/84, 85, 86, 347/87; 264/322, 321

(56) References Cited

FOREIGN PATENT DOCUMENTS

| | | | |
|---|---|---|---|
| 621478 | 10/1994 (EP) . | | |
| 691207 | 1/1996 (EP) . | | |
| 705701 | 4/1996 (EP) . | | |
| 709209 | 5/1996 (EP) . | | |
| 756935 | 2/1997 (EP) . | | |
| 7-47688 | 2/1995 (JP) . | | |
| 7-314727 | * 12/1995 (JP) | B41J/2/175 | |
| 7-323566 | * 12/1995 (JP) | B41J/2/175 | |
| 8-20115 | 1/1996 (JP) . | | |
| 9-183236 | 7/1997 (JP) . | | |
| 2000-141684 | * 5/2000 (JP) | B41J/2/175 | |

* cited by examiner

*Primary Examiner*—Judy Nguyen
(74) *Attorney, Agent, or Firm*—Fitzpatrick, Cella, Harper & Scinto

(57) ABSTRACT

An ink container includes an ink absorbing material for retaining ink and producing a negative pressure; a casing, provided with an ink supplying portion and an air vent, for accommodating the ink absorbing material; wherein the ink absorbing material is of thermoplastic material and has a surface ink blocking layer provided by heating and melting a surface of the absorbing material; wherein the ink blocking layer blocks movement of the ink contained in the ink absorbing material to outside, and constitutes at least a part of the casing.

22 Claims, 13 Drawing Sheets

INK CONTAINER HAVING BLOCKING MEMBER AND BOUNDARY LAYER

FIELD OF THE INVENTION AND RELATED ART

The present invention relates to an ink container as liquid containing means for an ink jet recording apparatus, an ink absorbing material as negative pressure producing means and a manufacturing method of the ink container.

Conventionally, the ink container for an ink jet recording apparatus is provided with an ink absorbing material such as an urethane foam resin material or felt to retain the ink while permitting supply of the ink to the ink jet recording head through the supply port thereof, wherein a negative pressure is produced using capillary force of the member. Recently, the ink jet recording apparatuses are widely used with the demand for the color printing and high quality printing, and therefore, the number of used ink containers increases. From the standpoint of environmental health, recycling of the material is desirable, and for easy recycling, a structure using a small number of parts of material or materials which are recyclable is desirable. It is desirable for an ink jet cartridge having a recording head and an ink container which are integral with each other that they are separable.

Japanese Laid-open Patent Application No. HEI- 8-20115 which has been assigned to the assignee of this application discloses an ink container using fibers of olefin resin material having a thermoplastic property as an ink absorbing material in the ink container. The ink container is good in the storing stability of the ink, and the ink container casing and the fiber material are of the same kinds of material, and therefore, the recycling is easy.

It further discloses that relatively smaller size fibers are disposed along the inner wall of the cartridge container, and relatively larger size fibers are disposed inside thereof.

Japanese Laid-open Patent Application No. HEI- 7-47688 discloses an ink container including an ink absorbing material having a heated and melted surface constituting a supply passage upon compression and having a reduced opening diameter to avoid blocking of the ink flow path due to bubble or foreign matter introduction, thus accomplishing the proper printing result.

It discloses that by contracting the opening diameter also at the side adjacent to the side wall of the ink container, the following problem is avoided. The problem is that air layer produced at the interface where the inner wall of the side surface of the ink container and the side surface of the ink absorbing material are close contacted to each other, enters the absorbing material as bubbles during ink consumption with the result of defect in the image quality or improper ink supply.

However, since the air layer per se remains even if the surface of the ink absorbing material is heated and melted, there would be a liability that improper ink supply occurs.

SUMMARY OF THE INVENTION

Accordingly, it is a principal object of the present invention to provide an ink container which is readily recyclable, and the entering of the air through the surface of the ink absorbing material is prevented.

It is another object of the present invention to provide an ink container which is assuredly couplable with a recording head or a recording device even when the ink container is repeatedly mounted and demounted relative thereto, in addition to the principal object.

It is a further object of the present invention to provide an ink container wherein ink movement from the ink absorbing material to the supply port during the ink supply so that ink supply is stabilized, solely or in addition to the principal and/or second object.

It is a yet further object of the present invention to provide an ink absorbing material suitable for achieving the object, and a manufacturing method therefor, and to provided various means for decreasing the number of parts and/or improving the reliability during transportation.

According to an aspect of the present invention, there is provided an ink container comprising an ink absorbing material for retaining ink and producing a negative pressure; a casing, provided with an ink supplying portion and an air vent, for accommodating said ink absorbing material; wherein said ink absorbing material is of thermoplastic material and has a surface ink blocking layer provided by heating and melting a surface of the absorbing material; wherein said ink blocking layer blocks movement of the ink contained in said ink absorbing material to outside, and constitutes at least a part of said casing.

According to this aspect, a part of the ink container casing and the ink absorbing material are made integral, and there is not gap between the wall (casing) and the absorbing material at the integrated portion, so that improper ink supply attributable to the entering of the air through between the wall and the absorbing material.

Since the ink absorbing material is of a thermoplastic material, the recycling of the container is easy. Thus, the principal object is achieved.

The following is further improvements.

Where the portion of the casing having the ink supplying portion is formed by the ink blocking layer, the position of the absorbing material at the supply portion is not deviated despite repetition of the mounting and demounting of the ink container. Thus, the second object is achieved.

The casing may all be constituted by said ink blocking layer.

The ink supplying portion and said air vent may be openably sealed. 7. An ink container The present invention further provides an ink container comprising an ink absorbing material for retaining ink and producing a negative pressure; an ink supplying portion and an air vent; wherein said ink absorbing material is of thermoplastic material and has, at a part thereof, a surface ink blocking layer provided by heating and melting a surface of the absorbing material; wherein the ink blocking layer blocks movement of the ink contained in ink absorbing material.

It may further comprises a boundary layer having a smaller average porosity than that of inside of said absorbing material, at a region adjacent said ink blocking layer.

The present invention further provides an ink absorbing material for an ink container, comprising an ink absorbing portion for retaining ink and producing a negative pressure; an ink blocking layer of thermoplastic material in or at a surface of said ink absorbing portion, said ink blocking layer being produced by heating and melting said ink absorbing portion and blocking movement of the ink contained in said ink absorbing portion.

The present invention further provides a manufacturing method for an ink container including an ink absorbing material for retaining ink and producing a negative pressure and a casing for accommodating the ink absorbing material, comprising the steps of preparing an ink absorbing material of thermoplastic material; forming an ink blocking layer by heating and melting at least a part of a surface layer of the ink absorbing material.

The method may further comprises a step of forming a boundary layer having a smaller average porosity than that of inside of said ink absorbing material by heating and melting at least a part of the surface layer of said ink absorbing material and imparting a pressure to it during cooling, after said ink absorbing material preparation step.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

(First Embodiment)

Figure 1:
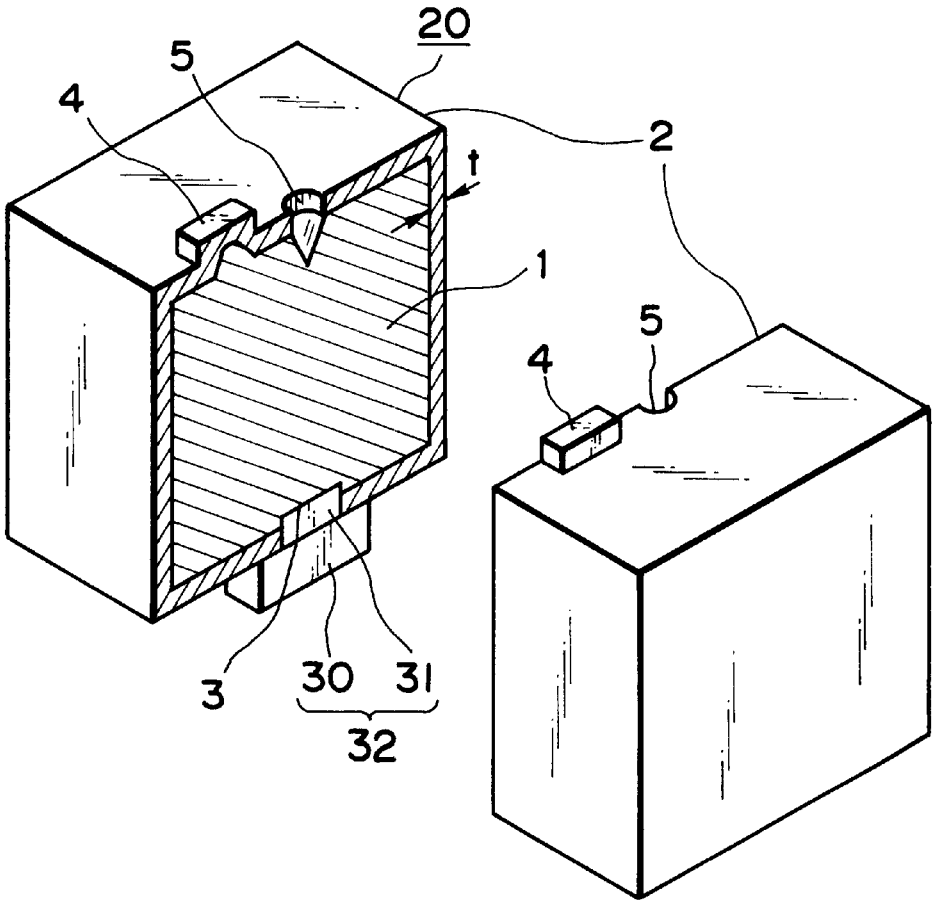
FIG. 1 is a schematic sectional perspective view illustrating a first embodiment of the ink container according to the present invention.

FIG. 1 shows an ink container according to a first embodiment of the present invention. FIG. 1 is a schematic sectional perspective view of an ink container according to a first embodiment of the present invention.

In the ink container 20 shown in FIG. 1, designated by 1 is an ink absorbing material as a negative pressure producing member for holding the ink for recording; 3 is an ink supply port for supplying the ink accommodated in the negative pressure producing member to the outside; 4 is a projection for mounting the ink container to the ink jet recording apparatus; and 5 is an air vent for introducing the ambient air into the negative pressure producing member. The mounting projection 4 is optional. The ink container 20 is detachably mountable relative to the ink jet head portion 32 at the ink supply port 3, and the ink jet head portion 32 includes an ejection head portion 30 for ejecting the ink accommodated in the ink container, and an ink supply tube 31 for supplying the ink to the ejection head portion from the ink container. The recording head is detachably mountable in this embodiment, but it may be integral with the ink container.

In the ink container 20 of the present invention, the ink absorbing material 1 is of fibrous material or member of thermoplastic resin material such as polypropylene fibers, and the surface layer thereof constitutes an ink blocking layer 2 formed by heat-fusing except for the ink supply port and the air vent, and the ink blocking layer constitutes a casing of the ink container.

The thickness t of the ink blocking layer is approx. 1.5 mm in this embodiment from the standpoint of the strength of the casing or the like. The layer is formed into a wall surface layer and is provided by the fiber material melted by heat entering into between the fibers of the negative pressure producing material adjacent the surface portion due to the capillary force of the negative pressure producing member or the like to fill the ink retaining spaces adjacent the surface layer of the negative pressure producing member, and the surface layer thus provided functions to block the ink therethrough.

As seen in the FIG. 1 (sectional view view), the thermoplastic material constituting the ink blocking layer 2 is not necessarily dense (solid) in all the region of the ink blocking layer 2, but fine spaces or gaps may exist. The thickness of the ink blocking layer is not necessarily uniform.

Depending on the manufacturing methods which will be described hereinafter, a boundary layer having a porosity (a ratio of the space per unit volume) smaller than that of the inside of the absorbing material in the inside region of the ink absorbing material of the ink blocking layer, may be provided. This will be described hereinafter.

With this structure, the casing of the ink container is unseparably integral with the negative pressure producing member. Therefore, such a side of the casing having the ink supply port is integral with the negative pressure producing member, so that portion of the negative pressure producing member faced to the supply port is not deviated despite the repetition of the mounting and demounting of the ink container. So, even in the case that mounting and demounting of the ink container relative to the ink jet head portion is repeated, the ink supply tube can be assuredly press-contacted to the negative pressure producing member.

The gap between the casing and the ink absorbing material at the ink supply port portion in the conventional ink container, is omitted at the portion where the casing is provided by processing the surface layer of the negative pressure producing member. According to the structure of the embodiment, there is no need of paying attention to the introduction of the air through the gap between the wall and the absorbing material, and therefore, improper ink supply attributable to the introduction of the air through between the wall and the absorbing material can be avoided.

By the integral structure of the ink absorbing material and the casing, the ink absorbing material is prevented from moving relative to the casing due to falling or another impact, so that ink supply performance to the ink jet recording head portion is not damaged.

The description will be made as to a manufacturing method of the ink container according to the present invention.

Figure 2:
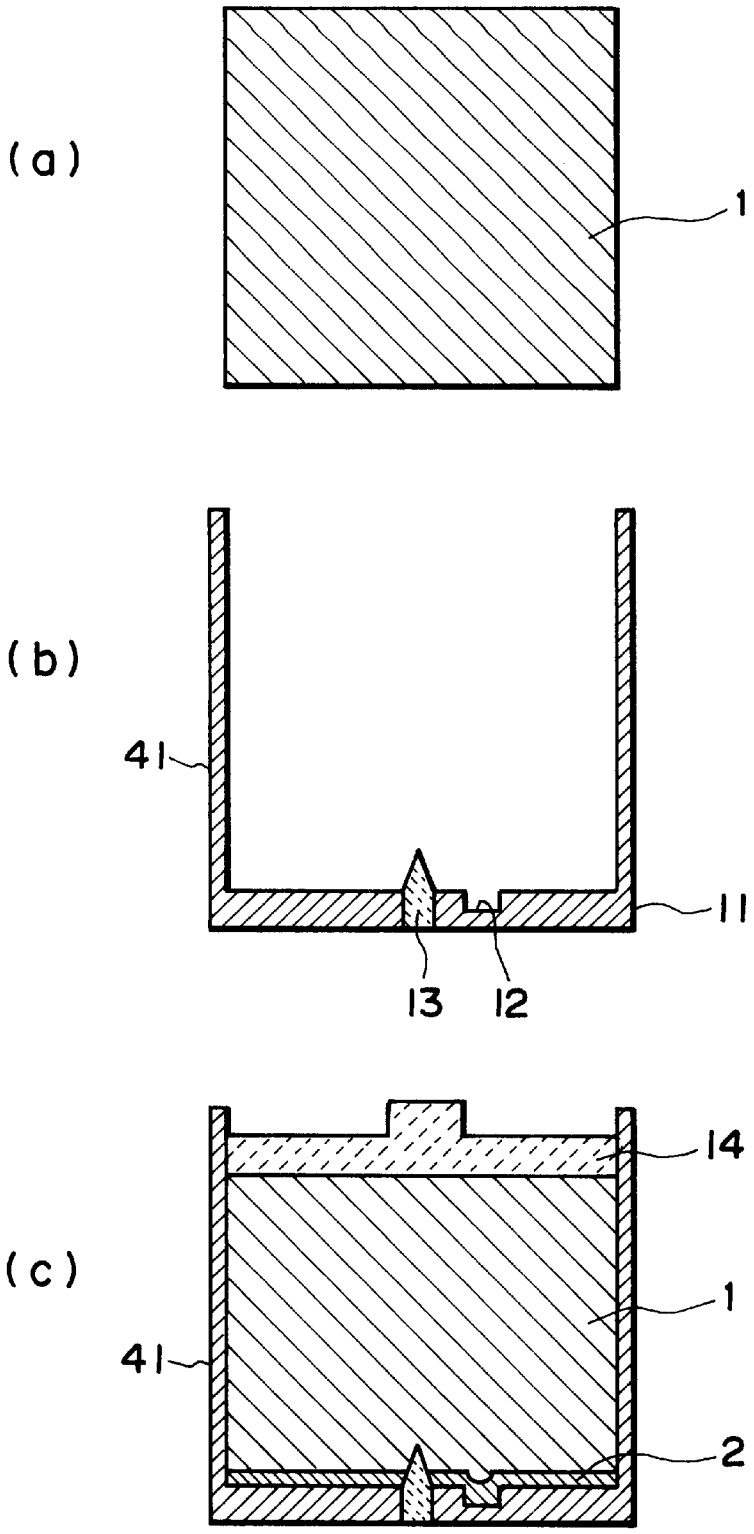
FIGS. 2(*a*)–(*c*) illustrate a manufacturing method of the ink container according to the present invention.

FIG. 2(*a*) shows the ink absorbing material 1 before the processing. The ink absorbing material in this embodiment is of polypropylene fiber having a fiber diameter of 30 $\mu$m and a fiber density of 0.1 g/cm3. The ink absorbing material 1 is such an aggregate of fibers that ink can be retained by the capillary force of the gap between the fibers. At this time, there is pores between the fibers at the surface of the ink absorbing material, similarly to the inside.

The material of the ink absorbing material is preferably easily fusable thermoplastic resin material particularly having a low thermal conductivity. This is because the low thermal conductivity permits the heat-fusing only at the heated portions, so that thickness of the ink blocking layer can be easily controlled. By the use of the fiber material for the ink absorbing material, an ink absorbing material having a desired density for generating a preferable negative pressure for the ink jet recording head can be easily prepared. As a manufacturing method for the ink absorbing material, the method disclosed in Japanese Laid-open Patent Application No. HEI- 9-183236 is usable.

Since the ink absorbing material of the present invention is of a thermoplastic material, the container after the use can be collected and reused as a material, thus improving the convenience for the recycling.

The use can be made with a mixture of a plurality of fiber materials with a desired mixing ratio, such as a mixture of polypropylene fibers and polyethylene fibers within a ration range not deteriorating the convenience for the recycling. From the standpoint of the hydrophilicity relative to the ink, the material is desirably a polyolefin material such as polyethylene fiber or polypropylene fiber. The present invention is usable with a foam material rather than a fibrous material if the ink blocking layer can be formed by heat-fusing the surface. When the fiber of the thermoplastic resin material is used, the gas permeability of a material having a higher crystal property than the normal injection molding, can be reduced. This is because in the case of a fibrous material, the resin material has been expanded in the spinning process, and therefore, even though it experiences the heat which is approximately the melting point of the resin material during the ink blocking layer formation, the temperature is lower than the normal injection molding, so that degree of crystallinity of the ink blocking layer finally provided is maintained high.

Then, the surface of the ink absorbing material is heat-fused, by which the ink blocking layer is provided. FIGS. 2(*a*)–(*c*) and FIGS. 3(*a*)–(*h*) show the processes of forming the ink blocking layer.

In the process of forming the ink blocking layer 2, the ink absorbing material 1 shrinks because the surface thereof is heated and fused, and the fused material fills into the pores. Therefore, it is desirable that size of the ink absorbing material prepared in FIG. 2(*a*) is slightly larger than the desired size of the final ink container.

First, as shown in FIGS. 2(*b*) and 2(*c*), the surface to be provided with an air vent is formed.

FIG. 2(*b*) is a sectional view of a mold 41 for forming the air vent. The bottom surface 11 of the mold of the material having a high thermo-conductivity is provided with a recess for forming, on the outer surface of the ink container, a projection 4 to be used for mounting it to the ink jet recording apparatus. The portion of the air vent is provided with a spear-like air vent forming member 13 of a material having a low thermo-conductivity, so that when the air vent is formed, the portion is not heated and melted.

As shown in FIG. 2(*c*), the ink absorbing material 1 shown in FIG. 2(*a*) is inserted into the mold 41. Then, a light pressure is imparted to the top of the ink absorbing material using the cap 14 or the like, and simultaneously, the bottom surface 11 of the mold is heated by a heater or the like for a predetermined period at a temperature not less than the melting point of the material constituting the ink absorbing material (desirably, a temperature not less than the highest melting point, when a plurality of materials are mixed), by which the ink blocking layer is formed. Thereafter, the mold is cooled, and the ink absorbing material is taken out of the mold, thus the one surface of the casing having the projection and the air vent can be provided.

When the ink absorbing material is of a plurality of materials, the heating temperature is not less than the melting point of the material having the lowest melting point. By this, the gaps between the fibers can be filled. In the case of an ink absorbing material having a large ratio of the space per unit volume, however, the amount of the thermoplastic material necessary for filling the gaps (ink retaining space) is large, it is desirable that temperature is not less than the melting point of the material having the highest melting point.

As regards the projection 4, the size of the projection is small in this embodiment, as compared with the size of the entirety of the ink container, and therefore, the ink absorbing material is substantially rectangular parallelepiped configuration. However, when the projection is large as compared with the volume of the ink container, the configuration of the prepared ink absorbing material is such that ink absorbing material has a projection at the correspondence position.

Figure 3:
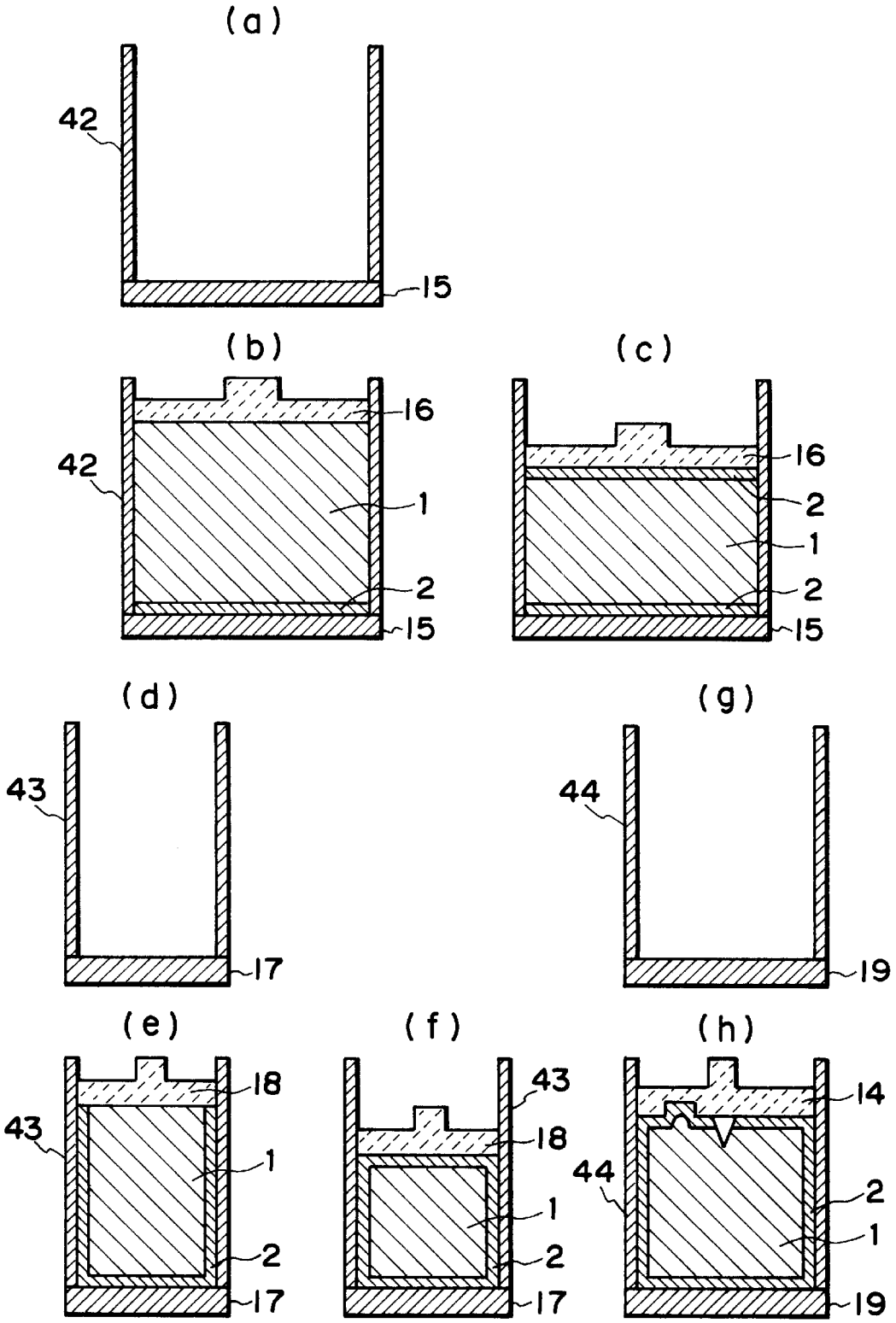
FIGS. 3(*a*)–(*h*) illustrate a manufacturing method of the ink container according to the present invention.

Then, as shown in FIGS. 3(*a*)–(*c*), another side is formed.

FIG. 3(*a*) is a sectional view of the mold 42 for heating the side surface to which the ink absorbing material is opposed. Similarly to FIG. 2(*b*), the bottom surface 15 of the mold shown in FIG. 3(*a*) is also constituted of the material having a high thermo-conductivity. In FIG. 3(*b*), the ink absorbing material is inserted into the mold with the non-heated side faced down. Similarly to the formation of the side having the air vent, a light pressure is imparted to the top of the ink absorbing material using the cap 16 or the like, and simultaneously, the bottom surface 15 of the mold is heated by a heater or the like, by which the ink blocking layer is formed.

Thereafter, as shown in FIG. 3(*c*), it is reversed by 180°, so that ink blocking layer is formed at the opposite side, similarly.

As shown in FIGS. 3(*d*)–3(*f*), the ink blocking layer is formed for each of the two remaining sides of the ink absorbing material. FIG. 3(*d*) is a sectional view of the mold 43 for heating the side surface to which the ink absorbing material is opposed. Similarly to FIG. 3(*a*), the bottom surface 17 of the mold shown in FIG. 3(*d*) is also constituted of the material having a high thermo-conductivity. In FIG. 3(*e*), the ink absorbing material is inserted into the mold with the non-heated side faced down. Similarly to the formation of the side having the air vent, a light pressure is imparted to the top of the ink absorbing material using the cap 18 or the like, and simultaneously, the bottom surface 17 of the mold is heated by a heater or the like, by which the ink blocking layer is formed. Thereafter, as shown in FIG. 3(*f*), it is reversed by 180°, so that ink blocking layer is formed at the opposite side, similarly.

Through the foregoing process, the ink blocking layer is formed for the surfaces other than the side having the ink supply port.

As shown in FIGS. 3(*g*)–(*h*), the process is carried out for the side having the ink supply port.

FIG. 3(*g*) is a sectional view of the mold, and similarly to the mold shown in FIGS. 2 and 3, the mold shown in FIG. 3(*g*) has a bottom surface 19 of a material having a high thermo-conductivity. As shown in FIG. 3(*h*), the ink absorbing material 1 for which the processing has been completed at the other sides is inserted into the mold 44, and a light pressure is imparted to the top of the ink absorbing material by a cap 21 or the like, and simultaneously the bottom surface 19 of the mold is heated by a heater or the like to provide an ink blocking layer.

After the cooling, it is taken out of the mold, and the resultant ink blocking layer is completely removed from the portion of the ink supply port. In place of removing the portion from the ink blocking layer, the same method as for the formation of the air vent is usable.

The ink blocking layer is formed in this manner, and the casing is completed, and then, the ink is filled into the ink absorbing material. In this embodiment, the ink injected into the ink container is all retained in the ink absorbing material, so that there is no ink existing in the small gaps between the casing and the ink absorbing material (so-called free ink). Since there is no need of paying attention to the air existing in the closed space formed by the absorbing material and the ink container wall surface, the size of the buffer region of the ink absorbing material adjacent air vent can be made smaller than that of conventional ink containers, even in view of the ambient condition change such as a temperature change or the pressure change. Thus, together with the non-existence of the ink in the gap between the ink absorbing material and the casing, the space usage efficiency of the ink container can be increased.

The filling method of the ink may be a pressure injection or reduced-pressure injection. The injection position is preferably the ink supply port, since then the ink can be assuredly exists adjacent the ink supply port.

In the foregoing manufacturing method of the ink container of the present invention, the ink absorbing material is molded to a desired fiber density and configuration so as to permit generation of the desired negative pressure, and then, the ink blocking layer is formed. This is desirable from the standpoint of the thickness control of the ink blocking layer which will be described hereinafter, the formation of the boundary layer and the easy handling in the manufacturing apparatus. When this is not necessary, the adjustment of the fiber density of the ink absorbing material and the formation of the configuration can be carried out simultaneously with the formation of the ink blocking layer.

As regards the order of ink blocking layer formation, it starts at the side having the air vent in this embodiment, but the order is not limited to this. The ink blocking layers may be formed at a plurality of sides simultaneously, or all the ink blocking layer can be formed all at once. When the ink blocking layers are formed for a plurality of sides simultaneously, it is preferable from the standpoint of the saving of the time required for the manufacturing that non-adjacent sides are processed simultaneously.

The description has been made as to the manufacturing method of an ink container having a substantially rectangular parallelepiped configuration, but the configuration is not limiting, and may be any, for example, cylindrical configuration.

In order to increase the physical strength of the ink blocking layer, the mold may be provided with an outward or inward groove (rib) or grooves (or ribs), to form it in the ink blocking layer during the heat-fusing.

In the conventional ink container manufacturing method, it is necessary to provide an inclination for permitting the product to be pulled out when the casing is produced using the injection molding, and therefore, tapering is necessary in the container configuration. With the resin material having a large molding contraction such as crystallized resin material, a large taper is required. Using the present invention, however, the ink blocking layer is used as a casing, the configuration of the mold can be changed from the conventional one, and therefore, an ink container having a complicated configuration can be formed, thus increasing the design latitude of the ink container. Additionally, the number of parts can be decreased so that easier recycling property is accomplished.

Figure 4:
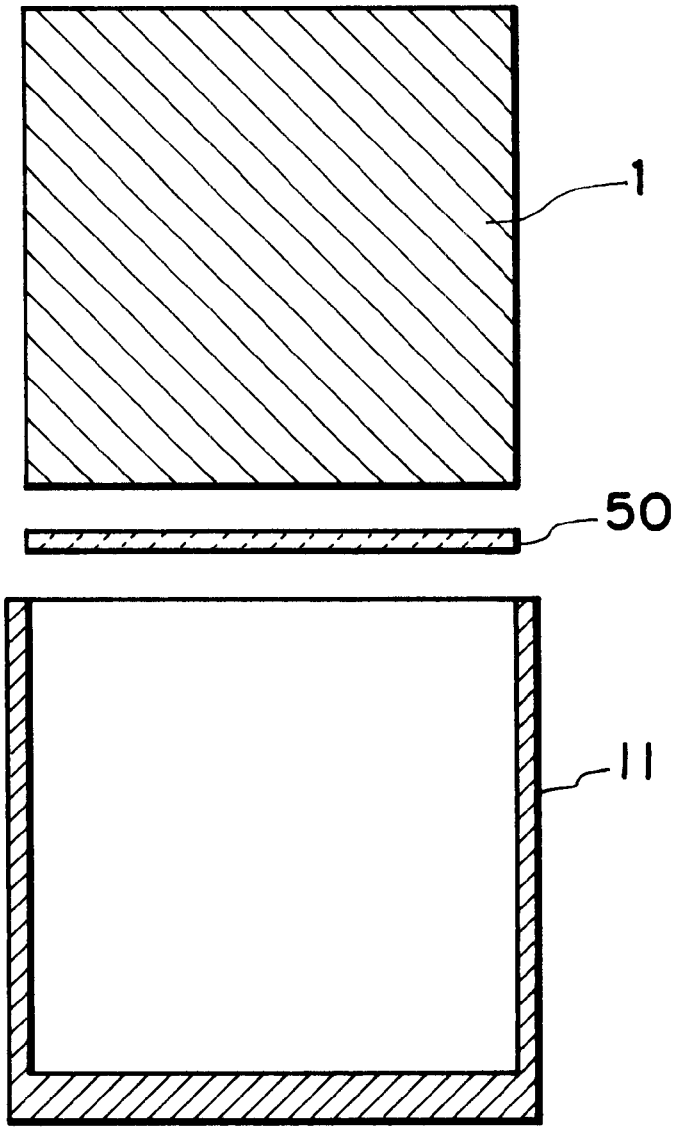
FIG. 4 illustrates a manufacturing method of the ink container according to the present invention.

In the manufacturing step of the ink blocking layer, as shown in FIG. 4, a separating member 50 which is separable from the ink absorbing material and the mold and which has a small thermal capacity such as aluminum foil is usable between the heating surface 11 of the mold and the ink absorbing material 1. By heating indirectly the ink absorbing material through the separating member, the ink absorbing material is separated from the mold together with the separating member, and the separating member is cooled to permit easy removal of the ink absorbing material from the mold, in place of the cooling process. There is no need of heating the mold again. The productivity is improved by selecting, for the mold, a material with the priority of the heat transfer property, and selecting, for the separating member, a material having a better releasing property relative to the absorbing material.

In the embodiment, the heating is effected through the mold. In another method for the indirect heating of the surface at which the ink blocking layer is to be formed, is to blow the ink absorbing material with heated air.

The description will be made as to the thickness of the ink blocking layer 2 which is one of the feature of the present invention.

The thickness t of the ink blocking layer 2 of the present invention shown in FIG. 1, can be changed without difficulty by changing the heating temperature, heating duration or time, porosity of the ink absorbing material and/or press-contact force between the mold and the ink absorbing material. It has been confirmed empirically that thickness is not dependent on the direction of the fiber in the above-described manufacturing method.

As regards the heating temperature and the heating time, the thickness of the ink blocking layer formed in the same time duration is larger when the temperature is higher, provided that heating temperature is higher than the melting point of the thermoplastic material constituting the ink absorbing material. If the heating temperature is the same, the thickness of the ink blocking layer increases with the duration of the heating.

The relation between the ink blocking layer and the porosity of the ink absorbing material is that thickness of the ink blocking layer formed during the same duration increases with the decrease of the porosity (increase of the ratio of the space occupied by the fiber), since the total of the gap voltage into which the melted resin material enters decreases. On the other hand, if the porosity of the ink absorbing material is the same, the thickness of the ink blocking layer formed during the same time increases with increase of the average diameter of the cross-section of the fiber.

When the ink blocking layer is provided by the heat-fusing of the surface layer of the ink absorbing material, the minimum thickness for the surface layer to function as the ink blocking layer varies with the surface tension of the used thermoplastic material and/or the wetting property of the mold relative to the fused resin material or the like, but practically, the ink blocking layer may be thinner if the pores in the surface layer decrease.

It has been found that when the ink absorbing material is constituted by the fiber material of a thermoplastic resin material, it changes with the porosity of the ink absorbing material and/or the sectional diameter of the fiber. More particularly, with the decrease of the porosity (increase of the percentage of the space occupied by the fibers), the total of the gaps which the fused resin material enters decreases, so that thin ink blocking layer with less pores can be formed. On the other hand, if the porosity of the ink absorbing material is the same, a smaller section average diameter of the cross-section of the fiber means a larger amount of the gaps. Such a small gaps can be easily filled with the fused resin material, and as a result, a smaller average diameter of the cross-section of the fiber requires thinner ink blocking layer with smaller amount of pores.

Using the above facts, a desired thickness of the ink blocking layer larger than the minimum thickness can be provided for a given ink absorbing material, but practically, the thickness of the ink blocking layer is desirably not less than approx. 1 mm in view of the shock resistance or the handling property (the minimum thickness as the casing when the user handles it). Particularly, a large ink container desirably has a large thickness of the ink blocking layer to enhance the shock resistance.

Figure 5:
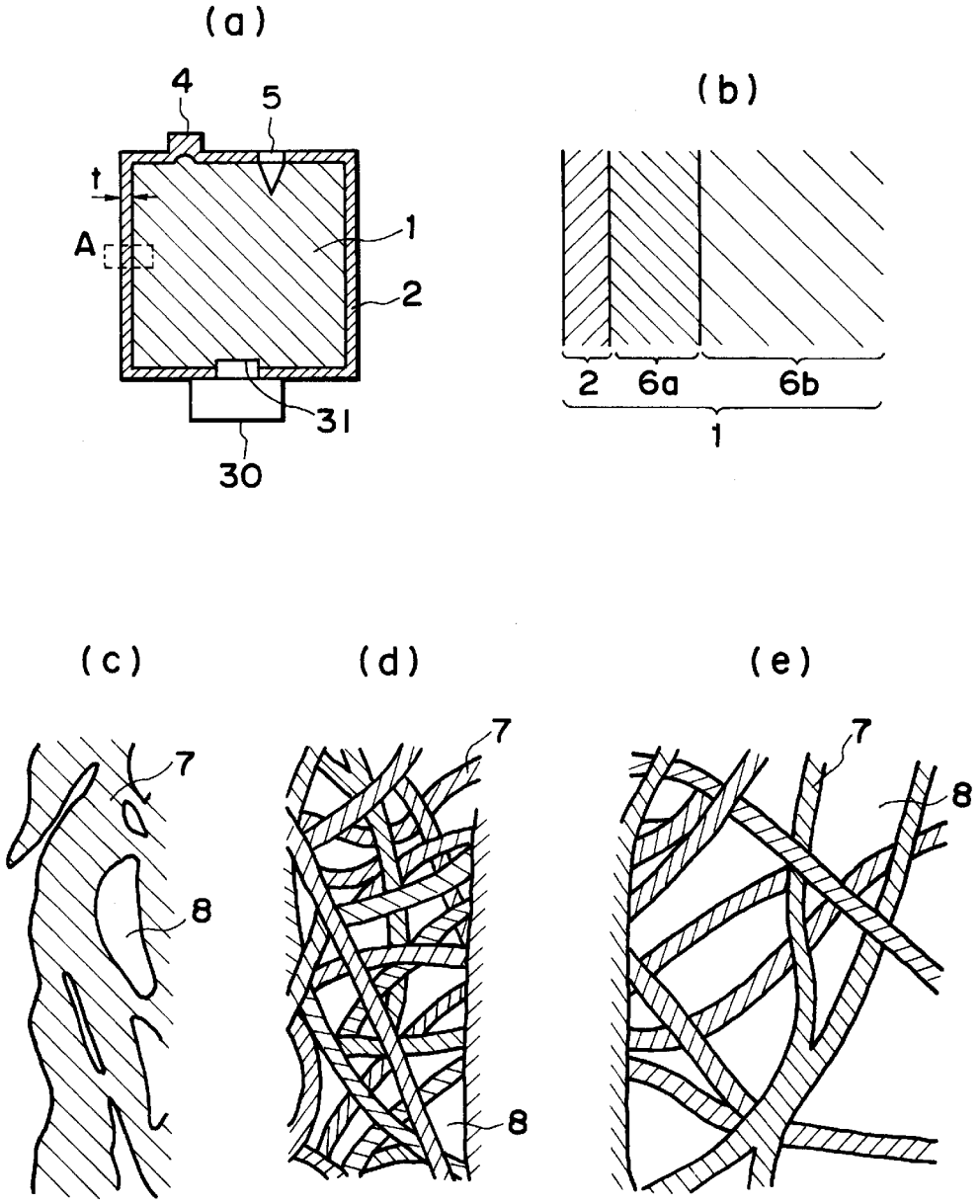
FIGS. 5(*a*)–(*e*) illustrate an ink blocking layer and a boundary layer of the ink container according to the present invention.

Referring to FIG. 5, the description will be made as to the boundary region between the ink blocking layer and the inside of the ink absorbing material.

An ink absorbing material of polypropylene resin material fibers having a melting point of 180° C. and a weight density of 0.1 g/cm3 and a diameter of 30 $\mu$m, has been prepared, and it has been heated at a heating temperature of 200° C. for approx. 30 sec with the pressure of approx. 5 kgf to produce the ink container having the ink blocking layer shown in FIG. 1, through the above-described method. The ink supply port was manufactured by machining the blocking layer after the ink blocking layer formation.

Then, the region indicated by A in FIG. 5(*a*) which is a sectional view across the line shown in FIG. 1 is observed with a SEM (scanning electron microscope). It has been found that region (boundary layer) 6*a* which is different from the ink blocking layer and also from the inside of the ink absorbing material exists between the ink blocking layer 2 and the inside of the ink absorbing material, as shown in FIG. 5(*b*). The average thickness of the boundary layer 6*a* of this ink container having an average thickness of 0.9 mm of the ink blocking layer 2, was approx. 2 mm.

FIGS. 5(*c*), (*d*), (*e*) show the fibers 7 (indicated by hatched lines) and the space 8 when the ink blocking layer 2, the boundary layer 6*a* and the inside region 6*b* of the ink absorbing material shown in FIG. 5(*b*) is observed through the SEM.

Here, the ink blocking layer shown in FIG. 5(*c*) has spaces 8 in the form of pores at some positions, but it is independent closed spaces, so that ink is blocked by the fused fibers 7. On the other hand, in the region 6*b* in the ink absorbing material shown in FIG. 5(*e*), the ink absorbing material can retain the ink by the capillary force of the gaps 8 formed between adjacent fibers 7.

In the boundary layer 6*a* shown in FIG. 5(*d*), the number of the fibers 7 per unit volume is larger than in the region 6*b* in the ink absorbing material, and the gaps 8 between the adjacent fibers 7 are narrower due to fusing of a part of the fibers. In other words, the boundary layer has a smaller porosity than the inside of the absorbing material, so that capillary force and the seeping force of the ink is larger than in the inside of the ink absorbing material.

The ink container of the embodiment is provided with the ink blocking layer at the surface of the absorbing material except for the air vent and the ink supply port, and is provided with the above-described boundary layer in the region at the ink absorbing material side of the ink blocking layer. At the surface of the ink absorbing material at the ink supply port portion, there remains the boundary layer without removal.

Therefore, the ink retained in the inside of the ink absorbing material having a smaller capillary force than the boundary layer and larger ink retaining amount (ink retaining efficiency) per unit volume can be supplied out assuredly through the boundary layer, and therefore, the usage efficiency of the ink accommodated in the ink absorbing material can be improved. Here, the boundary layer is integral with the ink blocking layer as the casing, and therefore, no air is introduced through gap between the casing and the absorbing material, and no closed space is formed by the gaps between the casing and the absorbing material, by which the ink movement through the boundary layer is assured and stabilized during the liquid supplying operation. From the standpoint of the supply performance of the ink, the capillary force of the boundary layer at each side are desirably similar.

When the recording head 32 is detachably mountable relative to the ink container, the ink exists always at the ink supply port portion irrespective of the mounting-and-demounting of the head portion since the boundary layer remains at the surface of the ink absorbing material at the ink supply port portion. Therefore, the distance of insertion of the ink supply tube of the recording head into the ink container can be made small. With the reduced insertion length, the liability of introduction of air at the time of mounting-and-demounting of the ink container relative to the recording head is decreased, and meniscus of the ink is formed at the surface portion, thus assuring the establishment of the ink supply path from the ink cartridge to the recording head.

The boundary layer of only one side may have such a high ink retaining force that ink movement does not occur despite a normal refreshing operation of the ink jet recording apparatus, and the ink blocking layer is of a semi-transparent material, by which the user can visually recognize the ink retaining amount depending on the difference of color between such a side and the other side.

The forming condition of the boundary layer will be described.

The boundary layer per se of the present invention can be formed, irrespective of the formation of the ink blocking layer, by heat-fusing the surface in which the formation of the boundary layer of the ink absorbing material is desired and cooling it, while imparting the pressure. The pressure may be imparted during the heating. The average porosity of the boundary layer is generally smaller if the pressure is smaller. The thickness of the boundary layer is generally larger if the heating duration is longer.

According to this embodiment, however, the heating temperature of the mold is not less than the melting point of the thermoplastic material, and the pressure is imparted during the ink blocking layer formation process, so that ink blocking layer and the boundary layer adjaent to the ink blocking layer are simultaneously formed, and therefore, the number of manufacturing steps can be reduced.

Alternatively, the heating temperature of the mold is changed while the ink absorbing material is in the mold, and during the ink blocking layer formation, the pressure is not imparted so that substantially only the ink blocking layer is formed, and when the heating temperature is lower, the pressure is imparted to form the ink boundary layer. In this case, the ink blocking layer and the boundary layer can be continuously formed without taking the ink absorbing material out of the mold, so that complicated process can be omitted, while permitting formation of the ink blocking layer and the boundary layer with desired thicknesses. When a mixed fiber comprising a core material of polypropylene having a melting point of 180° C., a diameter of 30 $\mu$m and a density of 0.1 g/cm$^3$ and a sheath therearound of polyethylene having a melting point of 132° C. (mixing ratio 1:1), the material is first heated for 1 min. At the heating temperature of 200° C. to form an ink blocking layer having a thickness of 1.5 mm, and then is heated for 5 min. At 170° C., and thereafter, the material is pressed by 5 kgf for 15 sec during the cooling, by which the boundary layer having a thickness of 1.5 mm is formed.

Either of the ink blocking layer and the boundary layer may be formed first, but when the boundary layers which are thick (for example, not less than 0.5 mm) are to be form at a plurality of adjacent sides, it is desirable that boundary layers are formed first so that ink blocking layer does not interfere during the pressurization, or it may be formed simuly.

The description will be made as to the difference in the heating temperature and the forming condition depending on the kind of the thermoplastic resin material.

When the ink absorbing material is of the fiber material of a single material such as polyethylene or polypropylene, the boundary layer is formed in the region heated to a temperature not lower than the softening point (thermal deformation temperature) and not higher than the melting point of the thermoplastic resin material constituting the fiber material. In such a region, the fiber is softened by the heating; and by the pressure imparted thereafter, the distance between the adjacent fibers is shorter than that in the other regions. By cooling the material with such a state kept, the fiber is cured so that boundary layer is formed. Therefore, the relation between the heating temperature and the average porosity is such that if the pressure is the same, the average porosity is smaller when the heating temperature is higher within the range not higher than the melting point of the thermoplastic resin material constituting the fiber material.

The description will be made as to the ink absorbing material is made of a fiber material of a plurality of materials such as mixed fiber of polypropylene and polyethylene materials or a fiber (sheathed fiber) comprising a core material having a relatively high melting point and a sheath material thereon having a relatively low melting point. When the heating temperature is lower than the melting point of the material of the materials constituting the ink absorbing material that has the minimum melting point, the boundary layer is formed through the same mechanism as with the fiber of a single material, but the boundary layer is not sufficiently formed as the case may be, for example, when the quantity of the material which softens at the temperature is small. When the heating temperature is between the melting point of the lowest melting point material and the melting point of the highest melting point material, a part of the low melting point material is fused to fill a part of the gaps between adjacent fibers, and therefore, a boundary layer having a small average porosity can be easily formed. Within such a temperature range, the average porosity decreases with increase of the heating temperature. It is desirable that softening point of the highest melting point material is substantially the same as or close to the melting point of the lowest melting point material.

The difference between the melting point of the lowest melting point material and the melting point of the highest melting point material is preferably within a predetermined range, particularly when the heating temperature during the boundary layer formation is close to the melting point of the highest melting point material. If the temperature difference is too small, all the resin material is melted under a normal temperature control in the manufacturing step with the result of difficulty in formation of the boundary layer; and if the temperature difference is too large, the boundary layer can be formed deeply into the ink absorbing material from the surface thereof.

The experiments have been carried out to investigate the forming conditions of the boundary layer, using the following sheathed fibers (the mixture ratio of the core material and the sheath material is 1:1);

(1) polypropylene having a melting point of 180° C. and ethylene propylene copolymer resin material having a melting point of 165° C.:

(2) polypropylene having a melting point of 180° C. and high density polyethylene having a melting point of 130° C.:

(3) ethylene propylene copolymer resin material having a melting point of 165° C. and ethylene-vinylacetate copolymer resin material having a melting point of 90° C.:

(4) PET resin material having a melting point of 260° C. and high density polyethylene having melting point of 130° C. In the cases of (1), (2) and (3), the boundary layer having the desired porosity and thickness could be relatively easily obtained, but in the case of (4), the desired boundary layer could not be obtained. It results therefore that when the fiber is of materials having different melting points, the desirable temperature difference of the melting points of the materials is practically not less than 10° C. and not more than 80° C.

When the fiber is of two materials having different melting points, the sheathed fiber is preferable to simple mixed yarn, since then the boundary layer having a small average porosity can be easily provided. This is because the material having the low melting point functioning as the adhesive material can be uniformly present at the crossing points between the fibers having the high melting point.

Even if the same sheathed fibers are used, the formation of the boundary layer is different depending on the ratio between the high melting point material and the low melting point material. More particularly, when the content of the core material (high melting point material) is too large, the situation is almost the same as with the single material fiber. If the content of the sheath material (low melting point material) is too large, there arises a liability that gaps between the fibers are completely filled. Therefore, the weight ration between the core material (high melting point material) and the sheath material (low melting point material) is approx. Within 7:3 to 5:5.

(Second Embodiment)

FIG. 2 shows an ink container according to a first embodiment of the present invention. This embodiment is different from the first embodiment in that ink blocking layer is used as a part of the casing only at the side having the ink supply port.

Figure 6:
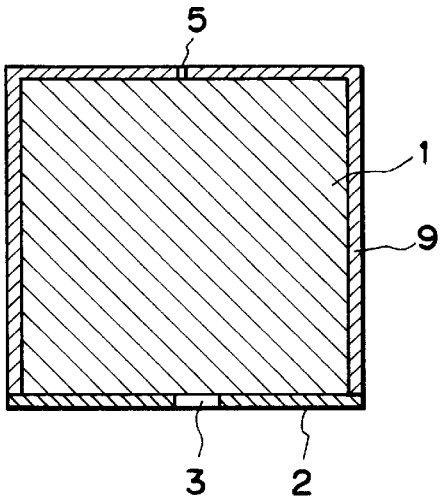
FIG. 6 illustrates an ink container according to a second embodiment of the present invention.

In FIG. 6, the ink blocking layer 2 is formed only at the side of the ink container to be contacted to the ink supply port of the ink absorbing material, and the ink absorbing material is inserted into a capping container 9 constituting the rest sides of the casing. The capping container 9 and the ink blocking layer 2 are welded by ultrasonic welding or the like.

Similar to the first embodiment, the casing and the ink absorbing material are integrally formed at least adjacent the ink supply port of the casing. Therefore, when the ink discharge tube for supplying the ink to the ink jet head is pressed to the ink absorbing material, the ink absorbing material is not separated from the casing, thus minimizing the pressing of the ink supply tube to the ink absorbing material. In this embodiment, too, a part of the casing and the ink absorbing material are made integral, the shock resistance is high.

As a modified example of the embodiment, it is an alternative structure that casing and the ink absorbing material are made integral at any part of the casing, by which the shock resistance of the container is high.

(Third Embodiment)

Figure 7:
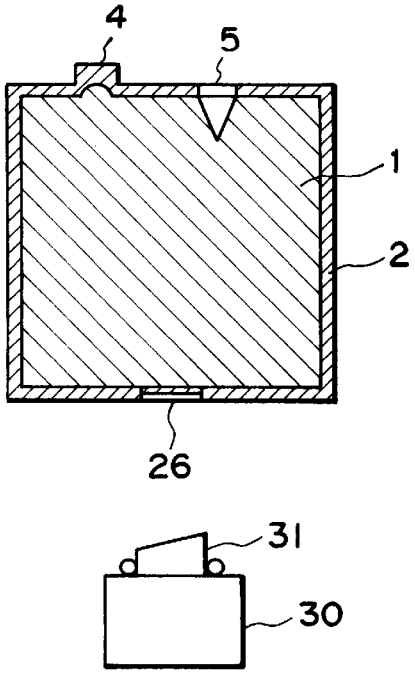
FIG. 7 illustrates an ink container according to a third embodiment of the present invention.

FIG. 7 is a schematic sectional view of the ink container according to a third embodiment of the present invention. In this embodiment, the ink container is provided with a thin portion 26 of ink blocking layer at the ink supply port.

As shown in FIG. 7, when the ink container is mounted to the ink jet head portion, the ink supply is started by breaking the thin portion 26 by the ink supply tube 31 of the ejection head portion 30. The thin portion has a smaller thickness than the other portion of the ink blocking layer, but thickness is within the range defined by equation (2), so that ink does not leak there. Such a thin portion is produced by scraping a part of the ink blocking layer at the position where to constitute the ink supply port, after the formation of the ink blocking layer when the side having the supply port is formed in the manufacturing step of the first embodiment. Alternatively, the portion of the mold corresponding to the thin portion may be slightly convexed, and the material of the mold at the portion may be the low thermo-conductivity material.

The provision of the thin portion of the ink blocking layer eliminates the necessity of using an independent seal member to prevent the ink leakage before the start of use, such as during the container being on the shelf or being transported.

The thin portion may be used not only for the ink supply port but also for the air vent. When the thin portion is used for both of the ink supply port and the air vent, the packaging is simplified, and transportation with hermetically sealed state is possible. In this case, the filling of the ink is carried out before the hermetically sealed space is formed.

Figure 8:
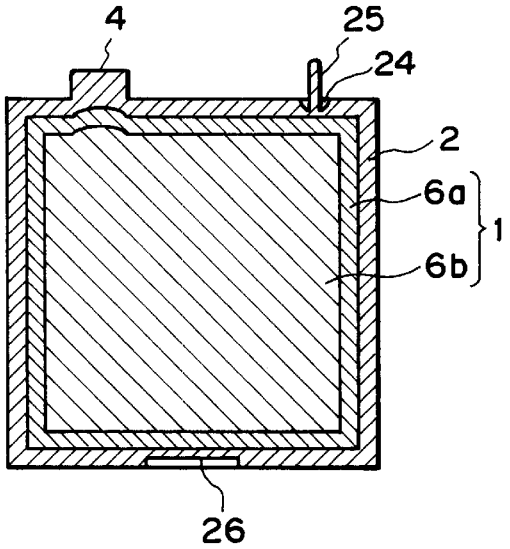
FIG. 8 illustrates an ink container according to a modified example of the third embodiment.

FIG. 8 is a schematic sectional view illustrating a state before the start of use of the ink container according to the modified example of the second embodiment of the present invention wherein the ink supply port is sealed by the ink blocking layer. In the modified example, for the convenience of the user, the ink blocking layer for the air vent is a rod-like projection 25 in the cut-away portion 24. The user breaks the projection at the start of use and remove it from the cut-away portion, by which the air vent is opened. The configuration of the ink blocking layer sealing the air vent is determined in view of the strength of the material and/or the bending property. In this embodiment, the ink filling is effected with the ink supply port portion being sealed by the ink blocking layer, and the portion of the air vent was machined finally.

In this modified example, as has been described with the first embodiment, a boundary layer 6*a* is provided at the ink absorbing material side region of the ink blocking layer. With the structure wherein the ink is filled in the boundary layer, the introduction of the air from the outside through the ink blocking layer to the inside of the absorbing material due to the osmotic pressure, can be remarkably reduced. When the ink in the boundary layer evaporates to the outside, the ink is supplemented from the ink absorbing material, and therefore, the above-described function is not deteriorated.

Thus, the ink container shown in FIG. 8 has an effect of preventing the introduction of the air thereinto. Therefore, the use of the thermoplastic resin material exhibiting a high barrier property against the water vapor despite a relatively poor barrier property against the air, among various thermoplastic resin materials, is desirable, since then the evaporation of the ink to the outside can be minimized despite a single material is used, and the introduction of the air thereinto can be effectively prevented, and in addition, the ink supply is stabilized during the use.

(Fourth Embodiment)

In the foregoing embodiments, the ink container can accommodate one kind of liquid, but it may be the one containing a plurality of liquids.

Figure 9:
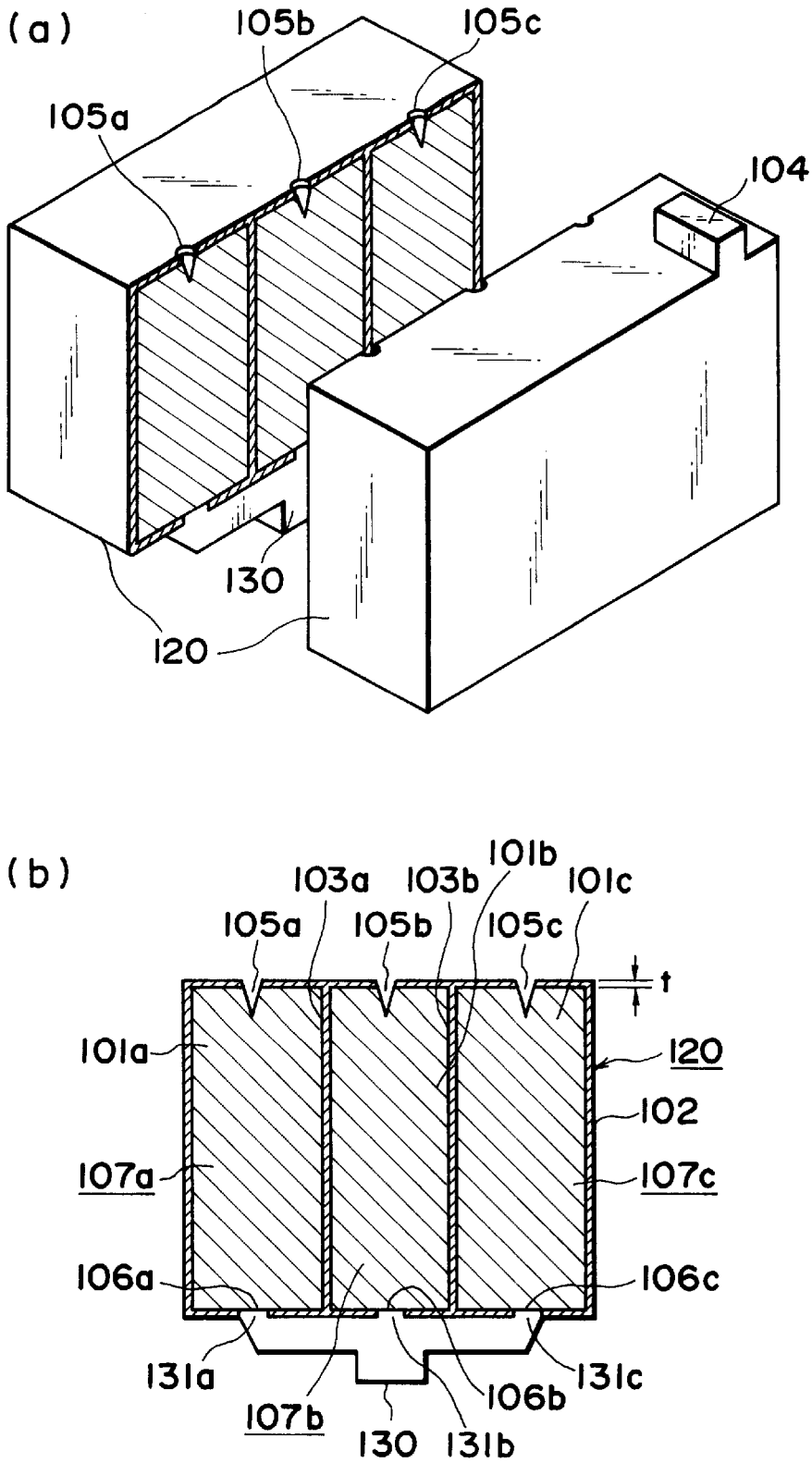
FIGS. 9(*a*) and (*b*) illustrate an ink container according to a fourth embodiment, wherein (*a*) is a schematic sectional perspective view, and (*b*) is a sectional view.

FIG. 9 is a schematic view of a color ink cartridge according to a fourth embodiment of the present invention, wherein (a) is a perspective sectional view, and (b) is a sectional view.

The color ink cartridge of FIG. 9 comprises an ink jet head 130 for ejecting yellow (Y), magenta (M) and cyan (C) inks, and an ink container 120 unified with the head. The ink jet head 130, as shown in FIG. 9(*b*), is connected with the ink container 120 through ink supply tubes 131*a*, 131*b*, 131*c*, and each ink is supplied to the ink jet head through the corresponding ink supply tubes. In this embodiment, the ink container and the ink jet head are integrated or unified with each other, but they may be separable from each other, wherein the ink jet head and the ink supply tube are unified (head cartridge).

The ink container 120 is provided with partition walls 103*a*, 103*b* in the casing 102, by means of which three inks are containable. The accommodating regions (ink accommodating portion s) 107*a*, 107*b*, 107*c* for the three inks in the casing provided by the partition walls, are provided with ink absorbing materials 101*a*, 101*b*, 101*c* as negative pressure producing members retaining the Y, M, C inks, ink supply ports 106*a*, 106*b*, 106*c* for connection with the ink supply tubes 131*a*, 131*b*, 131*c*, and air vents 105*a*, 105*b*, 105*c* for introducing the ambience into the ink accommodating portion.

The ink container 120 of the embodiment is provided at the outside with a projection 104 for mounting it to the ink jet recording apparatus, but the projection is not inevitable if it is not required for the mounting to the ink jet recording apparatus.

In this embodiment, too, the ink container 120 uses ink absorbing materials 101*a,* 101*b*, 101*c* each made of fibers of thermoplastic resin material such as polypropylene fiber. The casing 102 forming the ink accommodating portion, and the partition walls 103*a*, 103*b* are constituted by the ink blocking layer.

In this embodiment, the casing of the ink container is all formed by the ink blocking layer.

Therefore, the same effects as with the first embodiment are provided, and the provision of the ink blocking layers between the ink absorbing materials limits ink movement to the supply port in the ink absorbing material, so that plurality of inks can be supplied to the right supply ports with stability. In this embodiment, too, the provision of the boundary layer at the ink absorbing material side of the ink blocking layer is preferable.

Figure 10:
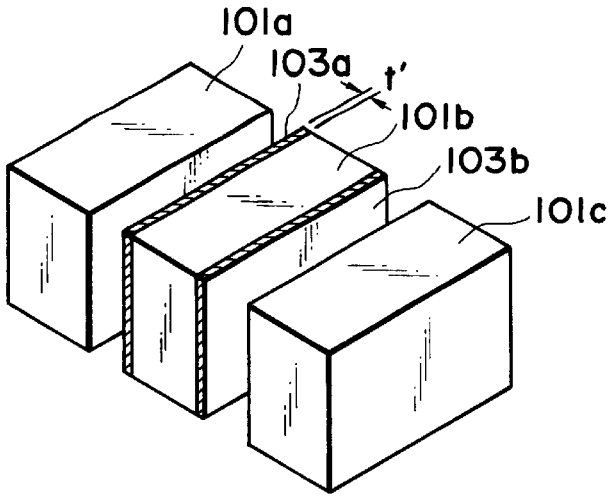
FIG. 10 illustrates a manufacturing method of the ink container according to the fourth embodiment.
Figure 11:
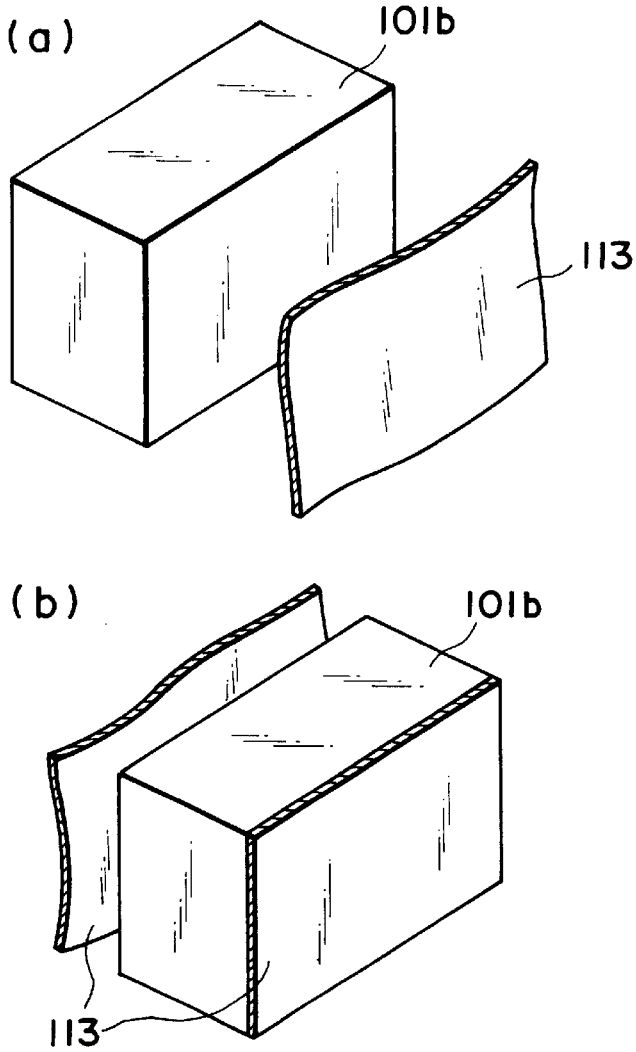
FIGS. 11(*a*) and (*b*) illustrate a manufacturing method of an ink container according to a modified example of the fourth embodiment of the present invention.
Figure 12:
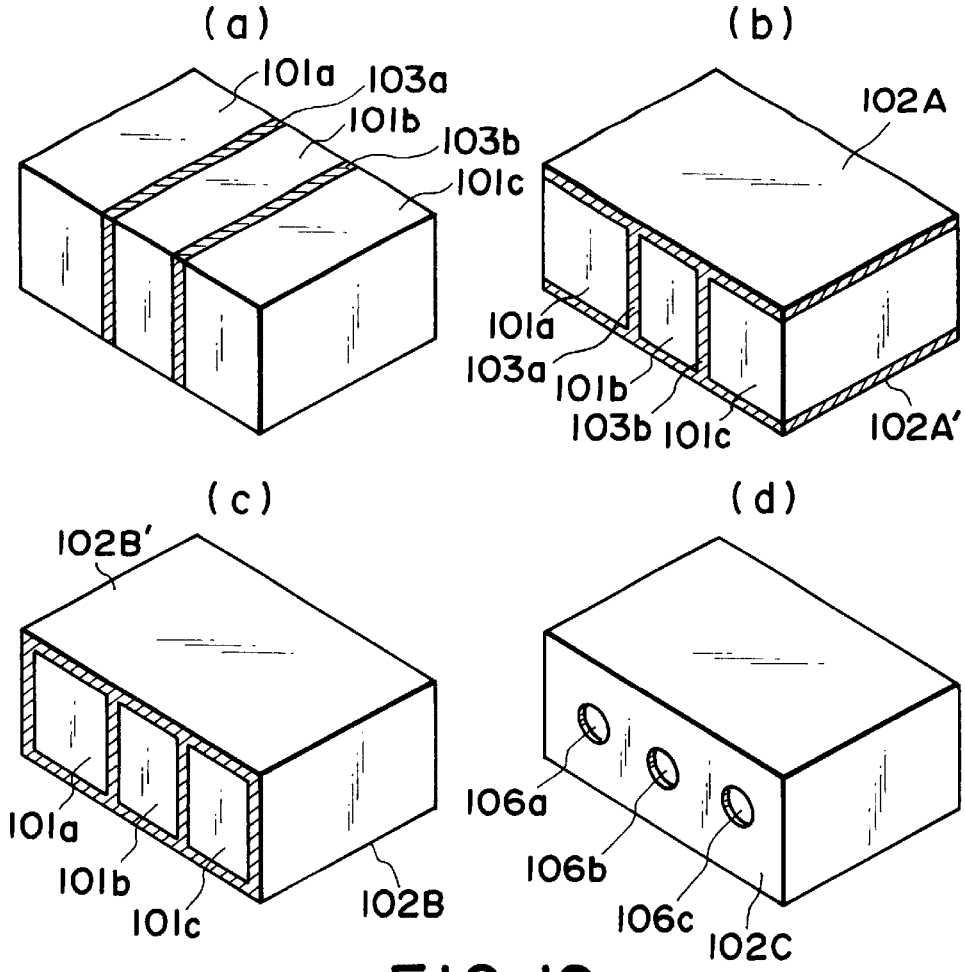
FIGS. 12(*a*)–(*d*) illustrate a manufacturing method. of an ink container according to a fourth embodiment of the present invention.

Referring to FIGS. 10, 11 and 12, the description will be made as to a manufacturing method for the ink container of the present invention.

As shown in FIG. 10, ink absorbing materials 101*a,* 101*b,* 101*c* for constituting the ink accommodating portions 107*a*, 107*b*, 107*c* of the ink container of the present invention. They are heated and melted at their surfaces during the manufacturing step for the ink blocking layer which will be described hereinafter, the volumes thereof reduces in the direction perpendicular to the contact surfaces. Therefore, it is desirable that sizes are larger than the sizes of the final products.

Then, the partition walls 103*a*, 103*b* of the ink blocking layer is formed in the central ink absorbing material 101*b*. The forming method may be the same as the manufacturing step of the first embodiment. However, although not shown in the Figure, the blocking layer is not extended to the end of the absorbing material, but the end is left unchanged by the proper design of the mold. This is preferable for the formation of the ink blocking layer at the sides adjacent to the 103*b* and 103*a*. This is usable with the embodiments described hereinbefore, and is preferable when the boundary layer is to be produced.

The ink blocking layer constituting the partition wall is not required to have a high strength as contrasted to the ink blocking layer constituting the casing, and therefore, the thickness t (FIG. 9(*b*) thereof may be smaller provided that it is not smaller than the above-described minimum thickness for the ink blocking layer.

In place of forming the ink blocking layer solely by the absorbing material, a plate-like member of a thermoplastic resin material having a compatibility which is the same as the ink absorbing material or a compatibility with the ink absorbing material, as shown in FIGS. 11(*a*) and (*b*). The manufacturing process in such a case will be described.

As shown in FIG. 11(*a*), two plate-like members 113 of a material which is the same kind of material as the ink absorbing materials 101*a,* 101*b,* 101*c,* are prepared. In this embodiment, the plate-like members 113 are in the form of film of polypropylene. As shown in FIG. 11(*b*), the film is attached on the ink absorbing material 101*b,* and the surface thereof is heated at a temperature not less than the fusing temperature of the plate-like member to unify it with the ink absorbing material 101*b*. With this method, the number of parts increases, but it is advantageous that thickness of the partition wall can be minimized by controlling the heating temperature and the time. This is applicable to any of the foregoing embodiments.

Then, as shown in FIGS. 12(*a*)–(*d*), the three ink absorbing materials are unified, and the casing of the ink blocking layer is constituted.

FIG. 12(*a*) shows the state in which the ink absorbing materials shown in FIG. 10 sandwiches the partition walls. Then, as shown in FIG. 12, (b), the ink absorbing material is taken as one piece, and wall surfaces 102A, 102A' constituting the casing of the ink blocking layer is molded in the same manner as the formation of the partition walls 103*a*, 103*b* for the ink absorbing material 101*b*. Subsequently, as shown in FIGS. 12(*c*) (*d*), the wall surfaces 102B', 102B 102C and 102C' constituting the casing of the ink blocking layer, the ink supply ports 106*a*, 106*b* and 106*c*, the air vents, and the projections (unshown) are molded.

After the casing is completed in this manner, the ink is filled into the ink absorbing material.

In the manufacturing method of the ink container of the present invention described above, the manufacturing process of the ink blocking layer is such that side having the air vent is first processed, but the order is not limiting. The ink blocking layers may be formed at a plurality of sides simultaneously, or all the ink blocking layer can be formed all at once.

In this embodiment, the partition walls 103*a* and 103*b* are formed on the negative pressure producing member 101*b,* but the partition walls may be formed on such sides of the walls 101*a* and 101*c* as are contacted to the negative pressure producing member 101*b*.

To provide the absorbing material shown in FIG. 12(*a*), the ink blocking layer may be formed simultaneously with the molding of the ink absorbing material into the desired configuration and density.

In a conventional ink container manufacturing method, leaves are to be provided for the injection molding of the casing, so that container configuration has to have a taper. With the increase of the number of inks to be accommodated in one ink container, the structure of the casing becomes complicated, with the result of less design latitude from the standpoint of manufacturing conditions.

However, according to the manufacturing method of the present invention, the configuration of the mold can be changed so as to Permit easy formation of the ink container having a complicated configuration, and non-requirement for the leaves improves the space efficiency with larger design latitude. Additionally, the number of parts can be decreased, so that conveniences for the recycling are improved.

In the embodiment, the contained inks are yellow, cyan and magenta inks, but may be another combination of inks. For example, it may contain processing liquid or the like which reacts with a predetermined ink such as yellow, magenta, cyan or black ink on the recording material or the like, and the accommodating portions may contain different density inks of the same kind.

When the contents of the inks are significantly different, there is no need of using the same material for the ink absorbing materials, and it is desirable to select the material from the same kind of thermoplastic resin materials which are compatible with each other in view of the reaction property to the inks, gas barrier property (resistance against the evaporation) or the like. By the selection of the materials having the compatibility with each other, the conveniences for the recycling is not deteriorated, while using the materials suitable for the inks which the ink absorbing materials accommodate. The number of the ink accommodating portions is not limited to three. This embodiment is applicable to the ink container for two or more inks.

As a modified embodiment, at least one of the ink accommodating portions may be used for accommodating the residual ink.

(Fifth Embodiment)

Figure 13:
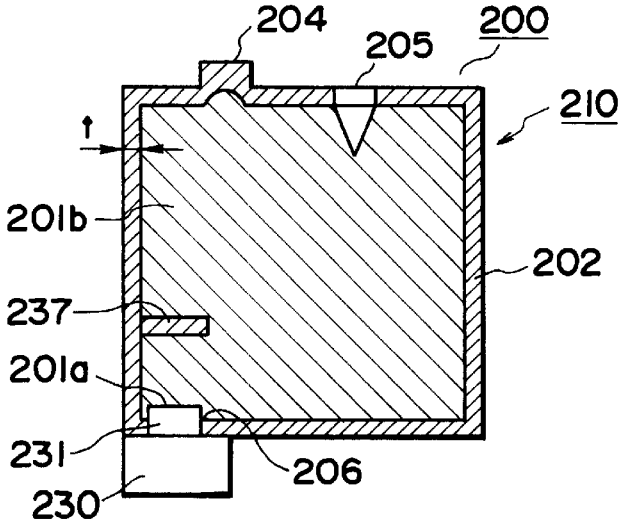
FIG. 13 illustrates an ink container according to a fifth embodiment of the present invention.

FIG. 13 is a sectional view of an ink cartridge 200 according to a fifth embodiment of the present invention. This embodiment is common with the fourth embodiment in that wall member integral with the ink absorbing material is provided in the ink absorbing material, but the embodiment is different in that single liquid is accommodated.

In this embodiment, the ink container 210 is provided with an ink absorbing material 201, a casing 202 made of ink blocking layer, a projection 204 and an air vent 205. To the ink supply port 206 of the ink container, an ink supply tube 231 is connected to permit ink supply to the recording head 230.

In this embodiment, a wall member 237 made of an ink blocking layer is provided in a region opposed to the ink supply port 206 in the ink absorbing material. In this embodiment, the wall member and the casing are constituted by the ink blocking layer, and one end of the wall member and the casing are made integral with each other, so that no positional deviation occurs even upon impact, and with the combination with the casing, a desired compression ratio can be provided.

By the provision of the wall member at the position opposing to the ink supply port as in this embodiment, the capillary force of the ink absorbing material 201*a* adjacent the ink supply port can be made larger than that in the other region 201*b* without difficulty. In the case that recording head provided with the ink supply tube 231 and the recording head 230 is connectable with the supply port of the ink container, desired repelling force can be provided, and the supply performance is maintained even if the connection and disconnection therebetween are repeated. By the provision of the wall member integrated with the ink absorbing material at a position in the ink absorbing material, the ink flow during the ink supply can be regulated to accomplish the stabilized ink supply. The provision of the boundary layer in the region at the ink absorbing material side of the ink blocking layer is preferable since then the movement of the ink is along the wall surface.

(Sixth Embodiment)

Figure 14:
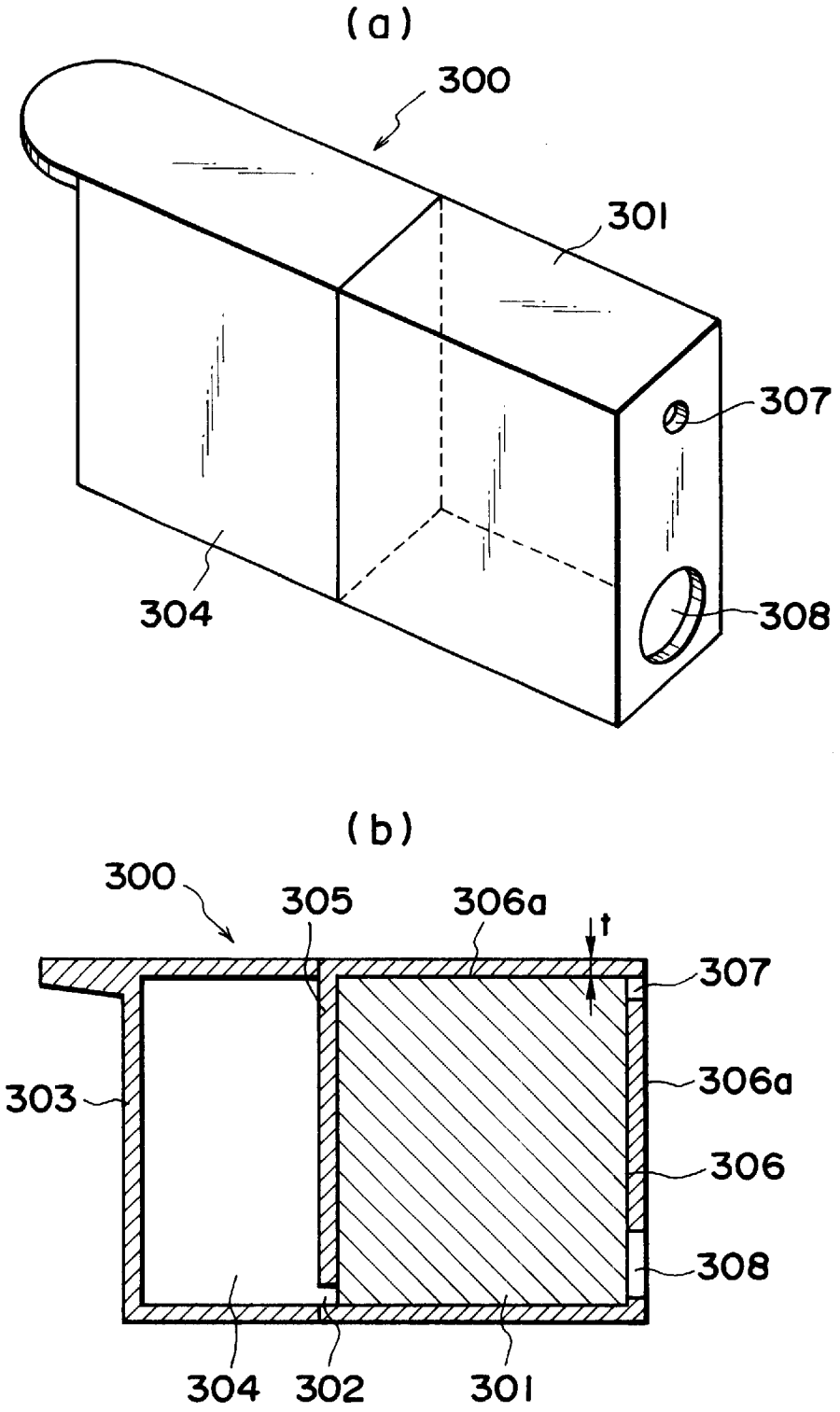
FIG. 14(*a*) is a schematic perspective view of an ink container as a liquid accommodating container according to a sixth embodiment of the present invention, and (*b*) is a sectional view thereof.

FIG. 14(*a*) is a schematic perspective view of an ink container as a liquid accommodating container according to a sixth embodiment of the present invention, and FIG. 14(*b*) is a sectional view thereof. In this embodiment, a wall member integrated with the ink absorbing material is provided in the ink container to regulate the flow of the ink.

The inside of the ink container 300 shown in FIG. 14 is divided into two spaces by a partition wall 305 having a communication port (communicating portion) 302. One of the spaces is hermetically sealed except for the communication port 302 formed in the partition wall 305, and constitutes a liquid containing chamber (second chamber) 304 for directly holding the liquid such as ink without mixture with another material or materials. The other space is an ink absorbing material accommodating chamber (first chamber) 801 for accommodating the ink absorbing material 306, and the wall constituting the ink absorbing material accommodating chamber 301 is provided with an air vent 307 for introduction of the ambience into the container and a supply port (liquid supply portion) 308 for supplying the ink to the recording head. When the ink is supplied out of the liquid supply portion to the unshown recording head, the ink in the ink absorbing material is consumed, and the ink is supplied to the ink absorbing material in the ink absorbing material accommodating chamber through the communication port formed by the partition wall from the ink accommodating chamber. At this time, the inside pressure of the ink accommodating chamber is reduced, but the air is introduced from the air vent through the ink absorbing material accommodating chamber and through the communication port of the partition wall into the ink accommodating chamber to ease the pressure reduction in the ink accommodating chamber. Therefore, even when the ink is consumed by the recording head, the ink is supplied to the absorbing material in accordance with the consumption amount, so that ink absorbing material retains substantially a constant amount of the ink, and therefore, substantially a constant negative pressure is maintained for the recording head, and the ink supply to the recording head is stable. In this embodiment, the ink absorbing material 306 of the ink container is made of fibers of thermoplastic resin material such as polypropylene fiber. The surface layer is the above-described ink blocking layer 806*a*, which constitutes the casing of the ink absorbing material accommodating chamber and the partition wall. On the other hand, the casing portion 803 except for the partition wall of the liquid containing chamber 304 is of the same thermoplastic resin material as the ink absorbing material, and is welded to the ink absorbing material accommodating chamber to be integral therewith.

In the manufacturing of the ink container of this embodiment, the ink absorbing material accommodating chamber having the air vent, the ink supply port and the communicating portion is manufactured using the manufacturing method of the first embodiment or the like, and then a capping container for constituting the liquid containing chamber is prepared, and then, they are welded so that partition wall is aligned with the opening of the capping container.

The liquid accommodating container manufactured in this manner has the ink absorbing material and the casing of the ink absorbing material accommodating chamber which are integral with each other, and therefore, no unintended gap is produced between the internal wall surface of the casing and the ink absorbing material. In the manufacturing step of the ink blocking layer, the ink absorbing material is imparted with such a small force that it is contacted to the surface of the mold having a heater, and therefore, the ink absorbing material does not acquire unintended compression distribution during the manufacturing step. Therefore, the manufacturing variation is small, and the productivity is high.

In the above-described manufacturing step for the ink absorbing material accommodating chamber, if the sides thereof are molded separately, It is preferable that side or sides not having any opening are first formed, and then, the side having the opening such as the supply port, the air vent, the communicating portion or the like, is formed, since then the accuracy is high. This is because the size of the ink absorbing material per se contracts in the direction perpendicular to the forming surface by the formation of the ink blocking layer. Particularly, it is desirable that partition wall which will constitutes the connecting portion relative to the liquid containing chamber and the side having the communicating portion is formed finally.

Figure 15:
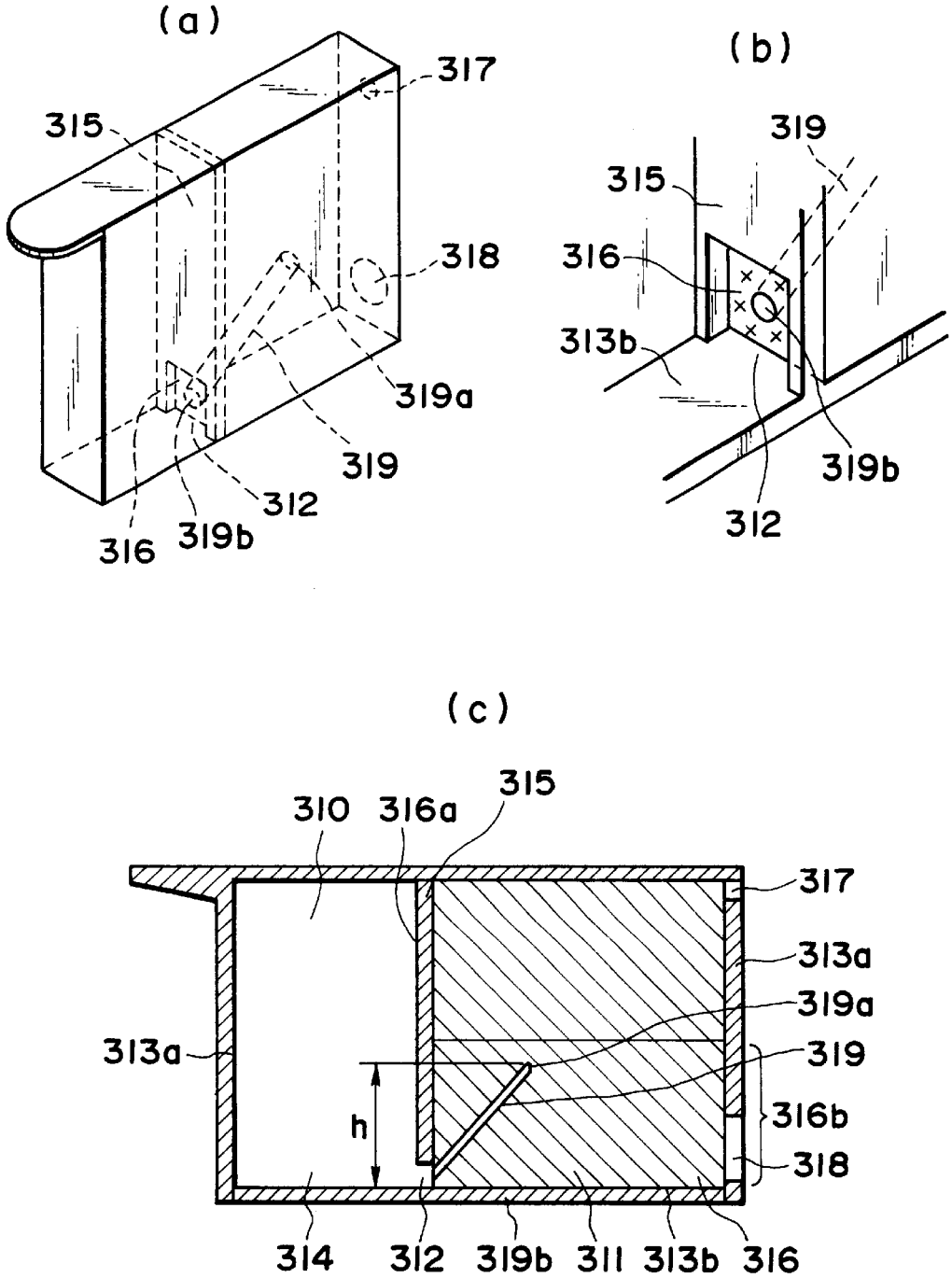
FIG. 15(*a*) is a schematic perspective view of an ink container as a liquid accommodating container according to a modified example of the sixth embodiment of the present invention, (*b*) is a partial perspective view of a neighborhood of a communicating portion, and (*c*) is a sectional view thereof.
Figure 16:
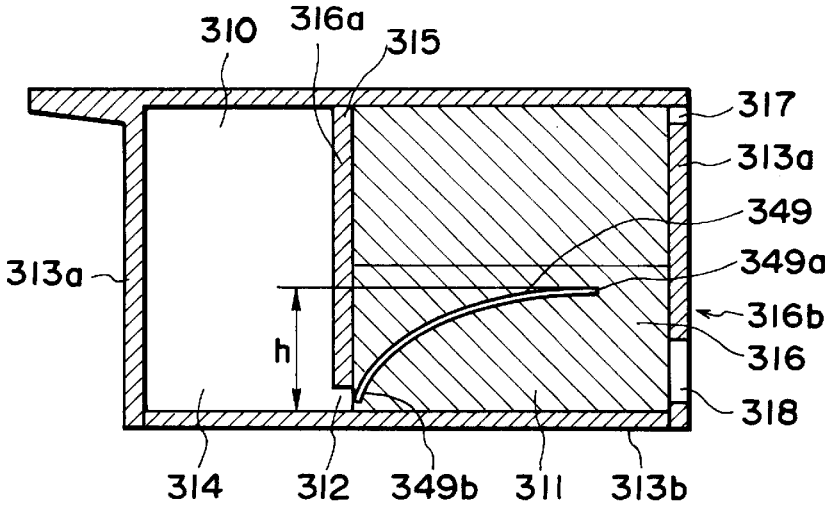
FIG. 16 is a sectional view of an ink container according to a modified example of the sixth embodiment of the present invention.
Figure 17:
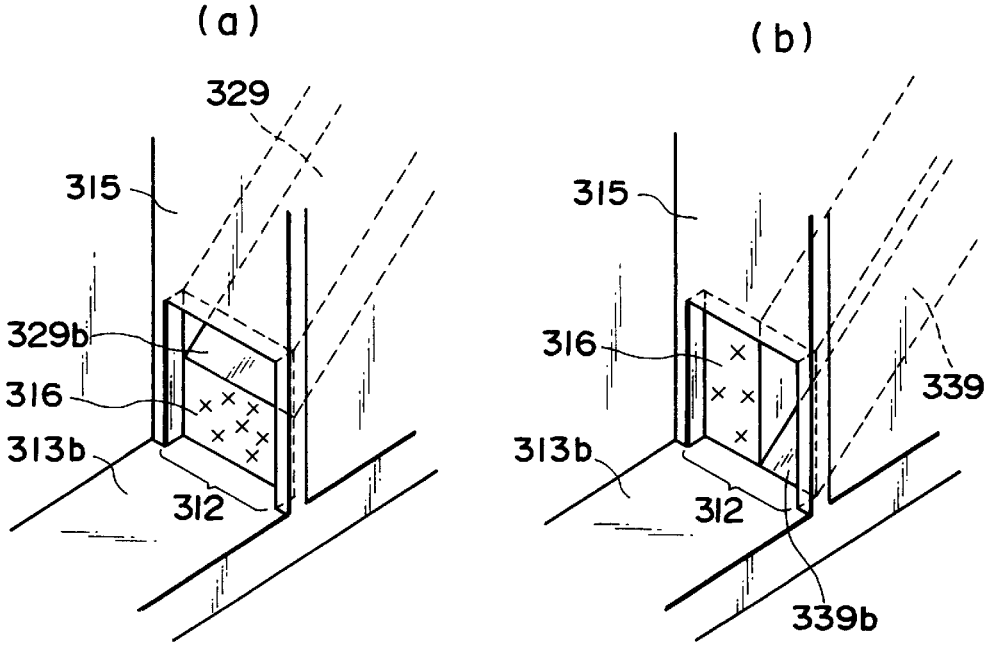
FIGS. 17(*a*) and (*b*) are partial perspective view of a neighborhood of a communicating portion of an ink container according to a further modified example of the sixth embodiment of the present invention shown in FIG. 15.

FIGS. 15–17 show modified examples of this embodiment.

FIG. 15(*a*) is a schematic perspective view of an ink container according to a modified example of the sixth embodiment of the present invention.

FIG. 15(*b*) is a partial perspective view of a portion adjacent the communicating portion, and FIG. 15(*c*) is a sectional view thereof. The structure of the ink absorbing material of this modified example is different from that of the above-described embodiment.

In this modified example, the inside of the ink container 310 is divided into two spaces by the partition wall 315 having the communication port (communicating portion) 332, similarly to the sixth embodiment. One of the spaces constitutes a liquid containing chamber (second chamber) 334, and the other constitutes an ink absorbing material accommodating chamber (first chamber) 311 for accommodating the ink absorbing material 316. The wall surface constituting the ink absorbing material accommodating chamber 311 is provided with an air vent 317 and a supply port (liquid supply portion) 818 for supplying the ink to the recording head.

In this modified example, the portions of the wall surface of the casing forming the first chamber and the second chamber of the ink container are provided by a cap member 313*b* plugging the opening of the container and the capping container 313*a*, and the partition wall 315 separating the first and second chambers and forming the communicating portion is provided by the blocking layer 316*a*. In the ink absorbing material 316, there is provided a hollow shaft (passageway) 319 which extends from the communicating portion 312 to a level h from the bottom surface (communicating portion side surface) to promote the gas-liquid exchange, wherein at least both of the ends 319*a* and 319*b* of the shaft are open. The end 319*b* of the shaft is at the communicating portion 312; and to the communicating portion 312, the end surface of the ink absorbing material 316 which is not melted as well as the end of the shaft, are exposed. In this modified example, when the liquid in the ink absorbing material accommodating chamber is consumed, to such an extent that liquid surface in the ink absorbing material reaches level h (from the bottom surface), the gas-liquid exchanging operation using the shaft as the gas-liquid exchange promoting structure, starts. More particularly, the gas is introduced into the liquid containing chamber 384 with the discharge of the liquid, and simultaneously, the liquid in the liquid containing chamber is supplied to the ink absorbing material accommodating chamber 311 through the end surface of the ink absorbing material 316 at the communicating portion 312.

In the this modified example, by the provision of the shaft as the gas-liquid exchange promoting structure, the liquid level h in the ink absorbing material is maintained during the gas-liquid exchange, so that ink can be supplied out with stability. By disposing the inside end surface of the shaft inside the ink absorbing material substantially at the central portion of the ink absorbing material, the variation of the negative pressure at which the gas-liquid exchange starts is substantially constant even if the fiber mass as the ink absorbing material involves more or less variation in the fiber density. Therefore, the liquid accommodating container products are free of variation and are capable supplying stably the liquid to the outside.

The liquid accommodating container is manufactured by providing the partition wall 315 in the ink absorbing material by the blocking layer 316*a*, forming the shaft 319 portion, and then inserting the ink absorbing material into the capping container 313*a*, and capping the opening of the capping container by a cap member 313*b*. As regards the manufacturing of the shaft portion, a heated rod member, for example, is inserted into the ink absorbing material 316 to provided the shaft portion, and then, the rod member is cooled and taken out. When the ink blocking layer is formed at the periphery thereof, it is desirable that temperature of the rod member is raised and that end of the rod member is provided with a portion having a low thermal conductivity to provide the opening at the end portion.

Since the partition wall of the liquid accommodating container is formed by the ink blocking layer, no unintended gap is formed between the partition wall and the ink absorbing material, and therefore, the manufacturing variation is reduced. In addition, by the provision of the gas-liquid exchange promoting structure in the ink absorbing material beforehand, the manufacturing variation is further reduced.

It is desirable to form a blocking layer in the entirety of the region (316*b* in FIG. 15(*c*)) below the end 319*a* of the shaft as a surface layer in the region below the top end portion of the passage, except for the liquid supply portion and the end of the passage, since then the ink supply is further stabilized, even if a gap is formed between the capping container 313*a* and the ink absorbing material.

As regards the structure of the shaft, as shown in FIG. 16, it may extend horizontally at the level h, and the periphery of the horizontal portion is provided with opening or openings relative to the ink absorbing material. The cross-sectional configuration of the shaft may be prism-like as shown in FIGS. 17(*a*) and (*b*). As regards the positional relation between the communicating portion 312 and the end of the shaft, the end 319*b* of the cylindrical shaft is disposed substantially at the center of the end of the ink absorbing material 316 which is not melted, in this embodiment, but this not inevitable. The position of the end of the shaft may be any if the non-melted end surface of the ink absorbing material 316 and the communicating portion side end of the shaft are provided. FIG. 17(*a*) shows a modified example wherein the end 329*b* of the shaft 329 is provided above the communicating portion 312, and FIG. 17(*b*) shows a modified example wherein the end 339*b* of the shaft 339 is distributed in one horizontal half of the communicating portion 312.

(Seventh Embodiment)

Figure 18:
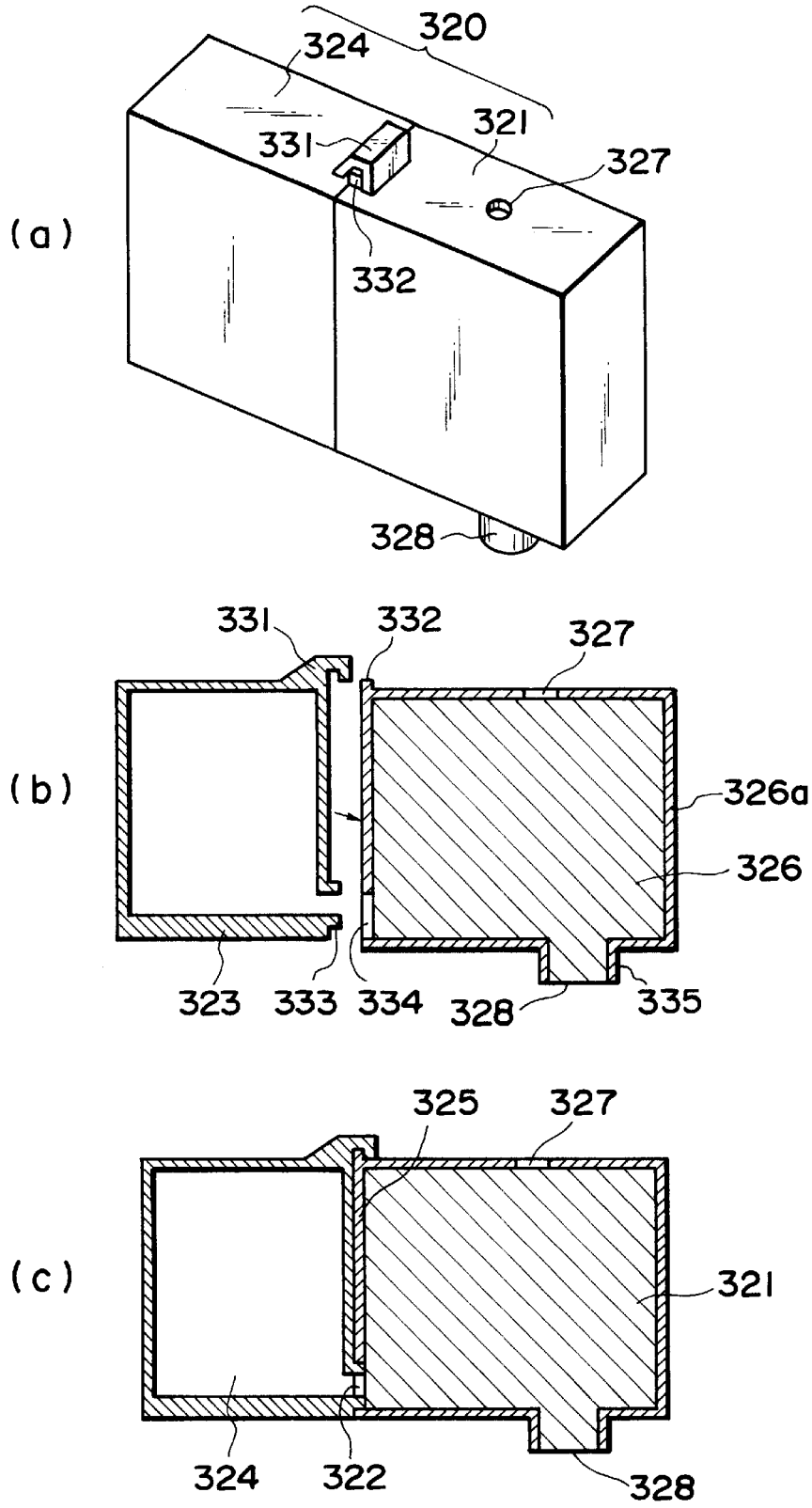
FIG. 18(*a*) is a schematic perspective view of an ink container as a liquid accommodating container according to a seventh embodiment of the present invention, (*b*) and (*c*) are sectional views.

FIG. 18(*a*) is a schematic perspective view of an ink container as a liquid accommodating container according to a seventh embodiment, and FIGS. 18(*b*) and (*c*) is sectional views. This embodiment is different from the above-described sixth embodiment in that ink absorbing material accommodating chamber and the liquid containing chamber are separable from each other and in the positions and the configurations of the supply port and the air vent of the ink absorbing material accommodating chamber.

The combined ink cartridge 320 of this embodiment comprises an ink absorbing material accommodating container 321 and an exchange liquid accommodating container 324. The two containers are separable from each other as shown in FIG. 18(*b*), and are engaged with each other by a male opening 333 forming a communicating portion 322 and a female opening 334 and by a hook 331 and a projection 332.

In the state shown in FIGS. 18(*a*) and (*c*), a partition wall 325 is formed by the wall of the casings of the exchangeable liquid accommodating container and the ink absorbing material accommodating container, and a communicating portion 322 is formed by the male opening 333 and the female opening 334. Similarly to the above-described embodiment, the liquid can be supplied to the ink absorbing material accommodating container from the exchangeable liquid accommodating container with the gas-liquid exchanging operation. The end of the male opening 333 of the exchange liquid accommodating container is shown as a simple opening, but a seal member may be provided which is opened upon the connection, by which the exchange liquid accommodating container may be exchanged without paying attention to the inclination of the exchange liquid accommodating container.

In this embodiment, all of the casing 326*a*, projection 332 of the ink absorbing material accommodating container and the ink supply port portion 335 are constituted by a blocking layer, and the end of the ink supply port portion 335 projected downwardly from the bottom surface has an ink supply port 328. The upper surface portion provided with the projection 332 has an air vent 327.

The ink absorbing material accommodating container of this embodiment can be manufactured in the same manner as with the first chamber of the sixth embodiment. When the configuration is complicated, as in the one having the projected ink supply port portion or the projection for engagement, the container having the complicated configuration is easily accomplished by designing the mold, without the necessity of inserting the ink absorbing material into the container, as in the conventional structure.

As described in the foregoing, a part of the ink container casing and the ink absorbing material are integrated, and there is no gap between the wall (casing) and the absorbing material at the portions where they are integral, so that improper ink supply due to the introduction of the air through between the wall and the absorbing material can be avoided. Additionally, the ink absorbing material is prevented from moving relative to the casing due to falling or another impact, so that ink supply performance to the ink jet recording head portion is not damaged. Since the ink absorbing material is of a thermoplastic material, the recycling of the container is easy.

Because the side of the casing having the ink supplying portion is constituted by the ink blocking layer, the position of the absorbing material at the supply portion is not deviated despite repetition of the mounting and demounting of the ink container. Therefore, when the ink supply tube is press-contacted to the ink absorbing material, the negative pressure producing member can be press-contacted to the ink supply tube assuredly. By the provision of the boundary layer having a smaller average porosity than the inside of the absorbing material at the ink absorbing material side of the ink blocking layer, the ink can be supplied always to the ink supply port portion despite the mounting-and-demounting of the head portion. Therefore, the distance of insertion of the ink supply tube of the recording head into the ink container can be made small. When the insertion degree is small, the liability of introduction of the air through the ink supply port is lowered when the connection or disconnection between the recording head and the ink container, and meniscus is formed by the ink at the surface portion, so that ink supply path from the ink cartridge to the recording head is satisfactorily formed.

By the fact that casing is all constituted by the ink blocking layer, the gap between the ink container casing and the ink absorbing material is substantially completely eliminated, and therefore, the above-described advantages can be provided. By the provision of the boundary layer, the ink retained in the ink absorbing material can be assuredly supplied out through the boundary layer, and therefore, the usage efficiency of the ink accommodation in the ink absorbing material can be enhanced. Here, the boundary layer is integral with the ink blocking layer as the casing, and therefore, no air is introduced through gap between the casing and the absorbing material, and no closed space is formed by the gaps between the casing and the absorbing material, by which the ink movement through the boundary layer is assured and stabilized during the liquid supplying operation.

Openably sealing the air vent and the ink supplying portion by the ink blocking layer, provides a high reliability package against the transportation or the like before the start of use of the ink container, without increasing the number of parts. With such a structure, the provision of the boundary layer and the filling of the ink in the boundary layer are desirable since then the introduction of the air due to the osmotic pressure into the absorbing material from the outside can be further assuredly prevented.

With the structure wherein the ink blocking layer is provided in the absorbing material or at a part of the surface, the movement of the ink is blocked by the ink blocking layer, so that ink movement from the ink absorbing material to the supply port can be limited during the ink supply.

While the invention has been described with reference to the structures disclosed herein, it is not confined to the details set forth and this application is intended to cover such modifications or changes as may come within the purposes of the improvements or the scope of the following claims.

What is claimed is:

1. An ink container comprising:

an ink absorbing material for retaining ink and producing a negative pressure;

a casing, provided with an ink supplying portion and an air vent, for accommodating said ink absorbing material;

wherein said ink absorbing material is of thermoplastic material and has a surface ink blocking layer provided by heating and melting a surface of the ink absorbing material;

wherein said ink blocking layer blocks movement of the ink contained in said ink absorbing material to outside, and constitutes at least a part of said casing.

2. An ink container according to claim 1, further comprising a boundary layer having a smaller, average porosity than that of an inside portion of said ink absorbing material, at an ink absorbing material side of said ink blocking layer.

3. An ink container according to claim 1, wherein said ink supplying portion is provided on a first side of said casing and wherein said first side is constituted by said ink blocking layer.

4. An ink container according to claim 2, wherein said boundary layer constitutes a surface of said ink absorbing material in a vicinity of said ink supplying portion.

5. An ink container according to claim 1, wherein said casing is all constituted by said ink blocking layer.

6. An ink container according to claim 5, wherein said ink supplying portion and said air vent are openably sealed.

7. An ink container according to claim 6, further comprising a boundary layer having a smaller average porosity than that of an inside portion of said ink absorbing material, at an ink absorbing material side of said ink blocking layer, and said boundary layer is filled with the ink.

8. An ink container according to claim 1, wherein said casing comprises a first chamber containing said ink absorbing material and provided with said ink supplying portion and said air vent, and a second chamber which is provided with a communicating portion in fluid communication with said first chamber and which is a substantially hermetically sealed.

9. An ink container according to claim 8, further comprising a passage for introducing ambient air, which is extended from a portion of said ink absorbing material adjacent said communicating portion to an inside of said ink absorbing material.

10. An ink container according to claim 9, wherein said ink absorbing material is provided with said ink blocking layer constituting a surface layer in a region of a side provided with said ink supplying portion beyond a top end portion of said passage, except for said ink supplying portion and an end of said passage.

11. An ink container comprising:

an ink absorbing material for retaining ink and producing a negative pressure;

an ink supplying portion and an air vent; wherein said ink absorbing material is of thermoplastic material and has, at a part thereof, a surface ink blocking layer provided by heating and melting a surface of the absorbing material;

wherein the ink blocking layer blocks movement of the ink contained in ink absorbing material.

12. An ink container according to claim 11, wherein said ink absorbing material is divided by said ink blocking layer into a plurality of parts for containing respectively different kinds of inks.

13. An ink container according to claim 11, further comprising a first chamber containing said ink absorbing material and provided with said ink supplying portion and said air vent, and a second chamber which is provided with a communicating portion in fluid communication with said first chamber and which is a substantially hermetically sealed.

14. An ink container according to claim 13, further comprising a partition wall which separates said first chamber and said second chamber and which forms said communicating portion, wherein said partition wall is provided by heating and melting a surface of the ink absorbing material.

15. An ink container according to claim 11, further comprising a boundary layer having a smaller average porosity than that of an inside of said ink absorbing material, at a region adjacent said ink blocking layer.

16. An ink container according to claim 11, wherein said ink blocking layer constitutes at least a part of a casing of said ink container.

17. An ink absorbing material for an ink container, comprising:

an ink absorbing portion for retaining ink and producing a negative pressure;

an ink blocking layer of thermoplastic material in or at a surface of said ink absorbing portion, said ink blocking layer being produced by heating and melting said ink absorbing portion and blocking movement of the ink contained in said ink absorbing portion.

18. An ink absorbing material according to claim 17, further comprising a boundary layer having a smaller average porosity than that of an inside portion of said ink absorbing portion, at an-ink absorbing portion side of said ink blocking layer.

19. An ink absorbing material according to claim 17, wherein said thermoplastic material is a polyolefin fibrous material.

20. An ink absorbing material according to claim 17, wherein said ink absorbing portion comprises two fiber materials having different melting points.

21. An ink absorbing material according to claim 20, wherein a temperature difference between the melting point of the material having a highest melting point and the melting point of the material having the lowest melting point is not less than 10° C. and not more than 80° C.

22. An ink absorbing material according to claim 17, wherein said ink absorbing portion is provided therein a passage for fluid communication with an outside.

* * * * *

UNITED STATES PATENT AND TRADEMARK OFFICE

CERTIFICATE OF CORRECTION

PATENT NO. : 6,270,206 B1
DATED : August 7, 2001
INVENTOR(S) : Eiichiro Shimizu et al.

It is certified that error appears in the above-identified patent and that said Letters Patent is hereby corrected as shown below:

Column 2,
Line 8, "provided" should read -- provide --.
Line 31, "is" should read -- are --.
Line 41, "7. An ink container" should be deleted.
Line 50, "comprises" should read -- comprise --.

Column 3,
Line 3, "comprises" should read -- comprise --.
Line 45, "method." should read -- method --.
Line 64, "view" should read -- views --.

Column 4,
Line 49, "view view)," should read -- perspective view), --.

Column 5,
Line 6, "container," should read -- container --.
Line 25, "0.1 g/cm3." should read -- 0.1 $g/cm^3$. --.
Line 28, "is" should read -- are --.

Column 7,
Line 20, "FIGS. 2 and 3," should read -- FIGS. 2(a)-(c) and 3(a)-(f), --.
Line 52, "be" should be deleted.
Line 53, "exists" should read -- exist --.

Column 8,
Line 48, "In another" should read -- Another --.
Line 52, "feature" should read -- features --.

Column 9,
Line 33, "a" should be deleted.
Line 51, "0.1 g/cm3" should read -- 0.1 $g/cm^3$ --.

UNITED STATES PATENT AND TRADEMARK OFFICE

CERTIFICATE OF CORRECTION

PATENT NO. : 6,270,206 B1
DATED : August 7, 2001
INVENTOR(S) : Eiichiro Shimizu et al.

It is certified that error appears in the above-identified patent and that said Letters Patent is hereby corrected as shown below:

Column 10,
Line 4, "is" should read -- are --.
Line 37, "gap" should read -- gaps --.
Line 43, "force" should read -- forces --.

Column 11,
Line 32, "At" should read -- at --.
Line 34, "At" should read -- at --.
Line 40, "form" should read -- formed --.
Line 44, "simuly." should read -- simultaneously. --.

Column 12,
Line 3, "of the material" should be deleted.
Line 35, "1.1);" should read -- 1.1): --.
Line 38, "165°C.:" should read -- 165°C.; --.
Line 41, "130°C.:" should read -- 130°C.; --.
Line 45, "C.:" should read -- C.; and --.

Column 13,
Line 7, "Within" should read -- within --.
Line 31, "it" should read -- there --.
Line 32, "that" should read -- in which the --.
Line 45, "equation (2)," should read -- condition (2), --.

Column 14,
Line 6, "remove" should read -- removes --.
Line 30, "is" should read -- being --.

UNITED STATES PATENT AND TRADEMARK OFFICE

CERTIFICATE OF CORRECTION

PATENT NO. : 6,270,206 B1
DATED : August 7, 2001
INVENTOR(S) : Eiichiro Shimizu et al.

It is certified that error appears in the above-identified patent and that said Letters Patent is hereby corrected as shown below:

Column 15,
Line 4, "forming" should read -- forms --.
Line 21, "constituting" should read -- constitute --.
Line 30, "is" should read -- are --.
Line 37, "the" (second occurrence) should read -- the partition walls --.
Line 49, "is compatibility" should read -- is compatible --.
Line 50, "material," should read -- material is provided, --.

Column 16,
Line 2, "FIG. 12, (b)," should read -- FIG. 12(b), --.
Line 4, "is" should read -- are --.
Line 7, "FIGS. 12(c)(d)," should read -- FIGS. 12(c) and (d), --.
Line 8, "102B 102C" should read -- 102B, 102C --.
Line 39, "Permit" should read -- permit --.

Column 17
Line 28, "head" should read -- head is --.
Line 56, "801" should read -- 301 --.

Column 18,
Line 16, "layer 806a," should read -- layer 306a, --.
Line 19, "portion 803" should read -- portion 303 --.
Line 47, "It" should read -- it --.
Line 55, "constitutes" should read -- constitute --.

Column 19,
Line 4, "332," should read -- 312, --.
Line 6, "334," should read -- 314, --.
Line 11, "818" should read -- 318 --.
Line 36, "chamber 384" should read -- chamber 314 --.
Line 41, "the" (first occurrence) should be deleted.
Line 52, "capable" should read -- capable of --.

UNITED STATES PATENT AND TRADEMARK OFFICE

CERTIFICATE OF CORRECTION

PATENT NO. : 6,270,206 B1
DATED : August 7, 2001
INVENTOR(S) : Eiichiro Shimizu et al.

It is certified that error appears in the above-identified patent and that said Letters Patent is hereby corrected as shown below:

Column 20,
Line 25, "this" should read -- this is --.
Line 37, "is" should read -- are --.

Column 22,
Line 20, "pressure;" should read -- pressure; and --.
Line 33, "smaller, average" should read -- smaller average --.

Column 23,
Line 5, "pressure;" should read -- pressure; and --.

Column 24,
Line 7, "pressure;" should read -- pressure; and --.
Line 16, "an-ink" should read -- an ink --.

Signed and Sealed this

Fifteenth Day of October, 2002

*Attest:*

*Attesting Officer*

JAMES E. ROGAN
*Director of the United States Patent and Trademark Office*